US008942602B2

(12) United States Patent
Onoda et al.

(10) Patent No.: US 8,942,602 B2
(45) Date of Patent: Jan. 27, 2015

(54) DEVELOPING DEVICE AND IMAGE FORMING APPARATUS INCLUDING SAME

(71) Applicants: Wataru Onoda, Suginami-ku (JP); Tomohiro Kato, Okazaki (JP); Tomohisa Yoshida, Toyokawa (JP); Dai Suwama, Toyokawa (JP); Hiroaki Takada, Toyokawa (JP)

(72) Inventors: Wataru Onoda, Suginami-ku (JP); Tomohiro Kato, Okazaki (JP); Tomohisa Yoshida, Toyokawa (JP); Dai Suwama, Toyokawa (JP); Hiroaki Takada, Toyokawa (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 31 days.

(21) Appl. No.: 13/726,816

(22) Filed: Dec. 26, 2012

(65) Prior Publication Data

US 2013/0164045 A1 Jun. 27, 2013

(30) Foreign Application Priority Data

Dec. 26, 2011 (JP) ..... 2011-282982
Dec. 26, 2011 (JP) ..... 2011-282983
Dec. 27, 2011 (JP) ..... 2011-284964

(51) Int. Cl.
*G03G 15/08* (2006.01)

(52) U.S. Cl.
USPC ..... 399/275

(58) Field of Classification Search
CPC ..... G03G 15/09; G03G 15/0921; G03G 2215/0609
USPC ..... 399/272, 273, 274, 275, 277, 267
See application file for complete search history.

(56) References Cited

U.S. PATENT DOCUMENTS 4,436,413 A * 3/1984 Oka ..... 399/253
5,206,458 A * 4/1993 Nishikawa ..... 399/274

(Continued)

FOREIGN PATENT DOCUMENTS

GB 2121323 A * 12/1983
JP 63-226675 A 9/1988

(Continued)

OTHER PUBLICATIONS

Decision to Grant Patent issued on Dec. 10, 2013, by the Japanese Patent Office in corresponding Japanese Patent Application No. 2011-282982, and an English Translation of the Decision (6 pages).

(Continued)

*Primary Examiner* — Robert Beatty
(74) *Attorney, Agent, or Firm* — Buchanan Ingersoll & Rooney PC

(57) ABSTRACT

A developing device having: a guide member creating a guide channel for guiding the developer being fed thereto while being supported on the developer support; and a regulating member regulating the amount of the developer that has passed through the guide channel, the guide member further creates a reflux channel in a gap from an inner surface of the housing, the reflux channel is connected to the guide channel via a communication channel such that the developer regulated by the regulating member returns toward an upstream end of the guide member, the upstream end of the guide member is disposed in a position opposed to the position where the magnetic flux density of the catch pole peaks, and the magnet assembly further includes a feeding pole that is disposed downstream of the catch pole and upstream of the developing pole, so as to be opposed to the guide channel.

13 Claims, 36 Drawing Sheets

(56) References Cited

U.S. PATENT DOCUMENTS

| | | | | |
|---|---|---|---|---|
| 6,041,207 | A * | 3/2000 | Ishiguro et al. | 399/275 |
| 6,681,092 | B2 * | 1/2004 | Terai | 399/267 |
| 7,050,745 | B2 * | 5/2006 | Kikuchi | 399/272 |
| 8,639,167 | B2 * | 1/2014 | Nakayama et al. | 399/284 |
| 2003/0086728 | A1 | 5/2003 | Kikuchi | |
| 2007/0025777 | A1 | 2/2007 | Tomita et al. | |
| 2012/0039638 | A1 * | 2/2012 | Park | 399/274 |

FOREIGN PATENT DOCUMENTS

| | | | |
|---|---|---|---|
| JP | 09-034261 | A | 2/1997 |
| JP | 10-198173 | A | 7/1998 |
| JP | 2003-107860 | A | 4/2003 |
| JP | 2005-107475 | A | 4/2005 |
| JP | 2007-024933 | A | 2/2007 |
| JP | 2008-015197 | A | 1/2008 |
| JP | 2010-091649 | A | 4/2010 |
| JP | 2010-217462 | A | 9/2010 |

OTHER PUBLICATIONS

Notification of Reasons for Refusal issued on Jan. 21, 2014, by the Japanese Patent Office in corresponding Japanese Patent Application No. 2011-282983, and an English Translation of the Notification (6 pages).

* cited by examiner

DEVELOPING DEVICE AND IMAGE FORMING APPARATUS INCLUDING SAME

This application is based on Japanese Patent Application Nos. 2011-282982, 2011-282983, and 2011-284964, respectively filed on Dec. 26, 2011, Dec. 26, 2011, and Dec. 27, 2011, the content of which is incorporated herein by reference.

BACKGROUND OF THE INVENTION

1. Field of the Invention

The present invention relates to a developing device including a regulating member for regulating the amount of binary developer to be fed to a developing area, and also relates to an image forming apparatus including the developing device.

2. Description of Related Art

Conventionally, such a developing device as mentioned above is widely used in electrophotographic image forming apparatuses. As shown in FIG. 26, to form a toner image by developing an electrostatic latent image formed on an electrostatic image support 80 such as a photoreceptor drum, for example, a conventional developing device 8 includes a housing 81, a stirring screw 82, a magnet assembly 83, a developing roller 84, and a regulating member 85.

The housing 81 is a casing of the developing device 8, and is fixed to, for example, the frame (not shown) of an image forming apparatus. Moreover, the housing 81 stores a binary developer (simply referred to below as a "developer") D including toner and magnetic carrier. The stirring screw 82 stirs the developer D in the housing 81, and feeds the developer D to a supply space created in the housing 81.

The magnet assembly 83 is disposed near the electrostatic image support 80, and fixed to the housing 81, for example. Moreover, the magnet assembly 83 is in the shape of, for example, a column or a cylinder, and has a plurality of magnetic poles in its circumferential direction. In the example shown in the figure, a catch pole S2, a regulating pole N2, a feeding pole S1, a developing pole N1, and a separating pole S3 are provided as the magnetic poles. Note that each magnetic pole will be described in detail later.

The developing roller 84 is a typical example of a developer support. The developing roller 84 is in the form of a sleeve, and is rotatable along the outer circumferential surface of the magnet assembly 83. Note that in the example shown in the figure, the developing roller rotates clockwise as indicated by arrow CW. Moreover, the developing roller 84 is disposed near the electrostatic image support 80. Hereinafter, an area where the developing roller 84 and the electrostatic image support 80 face each other at a close distance will be referred to as a "developing area Da".

The regulating member 85 is disposed in a position at a predetermined distance from the developing area Da counterclockwise along the outer circumferential surface of the developing roller 84, so as to face the developing roller 84 with a predetermined gap (clearance) from the outer circumferential surface.

Next, the magnetic poles of the magnet assembly 83 will be described in detail. The catch pole S2 is disposed so as to be opposed to the supply space of the developer D in the housing 81. Hereinafter, the position of the catch pole S2 will be considered as the most upstream of the path to feed the developer D. The regulating pole N2 is disposed immediately downstream of the catch pole S2, in a position opposed to the regulating member 85. The feeding pole S1 is disposed immediately downstream of the regulating pole N2 between the regulating pole N2 and the developing pole N1. The developing pole N1 is disposed immediately downstream of the feeding pole S1, in a position opposed to the developing area Da. The separating pole S3 is disposed between the developing pole N1 and the catch pole S2, and creates a repelling magnetic field therebetween, thereby creating a low magnetic area LM with a magnetic flux density of, for example, 5 mT or less.

In the developing device 8 thus configured, the developer D is fed in the following manner. First, the stirring screw 82 rotates in the housing 81, thereby frictionally charging the carrier and the toner in the developer D, so that the carrier and the toner electrostatically adhere to each other. Thereafter, the developer D is attracted (supplied) from the supply space in the housing 81 onto the outer circumferential surface of the developing roller 84 by magnetic force of the catch pole S2. Rotation of the developing roller 84 causes the developer D supported on the outer circumferential surface to eventually reach the regulating member 85, so that only the developer D that has passed through the clearance is fed downstream. In this manner, the regulating member 85 regulates the amount of developer D to be fed. Subsequently, the developer D reaches the developing area Da, and is used for developing an electrostatic latent image formed on the electrostatic image support 80, thereby forming a toner image.

Furthermore, the developer D not used in the developing area Da remains attracted onto the developing roller 84, and is fed further downstream. Thereafter, in the low magnetic area LM, the developer D falls from the developing roller 84 into the housing 81.

Note that to feed the developer D through rotation of the developing roller 84, a certain frictional force is required between the developer D and the developing roller 84. The frictional force is expressed by the product of a normal force and a frictional coefficient at the contact interface of the developer D and the developing roller 84. Here, the normal force is mainly a component of a magnetic force based on a magnetic field from the magnet assembly 83, and the component is oriented in the radial direction of the developing roller 84. For example, the distribution of magnetic flux densities for obtaining such a normal force ranges from about tens to hundreds of mT on the outer circumferential surface of the developing roller 84 having the magnet assembly 83 provided therein.

Incidentally, the amount of the developer D that is supplied to the developing roller 84 fluctuates mainly in accordance with a change in the volume of developer D in the housing 81 and/or rotation of the stirring screw 82. However, in the developing device 8, the amount of developer D to be supplied from the housing 81 can be slightly increased and can be regulated under a certain level or more of pressure by the regulating member 85. As a result, a uniform layer of developer D can be formed on the outer circumferential surface of the developing roller 84 regardless of fluctuations in the amount of the developer D that is supplied.

On the other hand, high pressure applied by the regulating member 85 results in stress on the developer D. For example, magnetic force causes the developer D regulated by the regulating member 85 to accumulate immediately before the regulating member 85, as indicated by broken line BL in FIG. 26. Friction and suchlike cause stress on the accumulated developer D. Such a developer D deteriorates over long-term use, and therefore it is necessary for the pressure by the regulating member 85 to be kept appropriately low.

To inhibit accumulation of the developer D, the space immediately before the regulating member 85 is conceivably narrowed as in a developing device 8' of FIG. 27. As a result, the amount of the developer D that receives stress immediately before the regulating member 85 decreases, but the developer D supplied from the housing 81 to the developing roller 84 is forced in a narrow space until it passes the regulating member 85, so that particles included in the developer D receive high stress. Moreover, stress on the developer D applied by the regulating member 85 might lead to an increase in torque of the developing roller 84 and deterioration of the developer D.

In view of the above problems, Japanese Patent Laid-Open Publication No. 2008-15197 (FIG. 1) describes a developing device including a slip control member in addition to a regulating member. The slip control member is positioned upstream of the regulating member at a predetermined distance along the outer circumferential surface of a developing roller. As a result, pressure is released before the regulating member, thereby inhibiting stress applied by the regulating member.

However, in the configuration of Japanese Patent Laid-Open Publication No. 2008-15197, the developer is accumulated at the upstream end of the slip control member, so that stress is still applied to the developer.

SUMMARY OF THE INVENTION

A developing device according to an embodiment of the present invention for forming a toner image by developing an electrostatic latent image formed on an electrostatic image support using a developer, the device including: a housing that stores the developer and has a supply space from which the developer is supplied; a developer support that is opposed to the electrostatic image support and rotates while supporting the developer supplied from the supply space, thereby feeding the developer to a developing area opposed to the electrostatic image support; and a magnet assembly that is fixed inside the developer support and has a plurality of magnetic poles, at least including a catch pole, a developing pole, and a separating pole, in which, the catch pole is opposed to the supply space so as to, attract the developer from the supply space onto the developer support, the developing pole is opposed to the developing area, the separating pole is disposed downstream of the developing pole and upstream of the catch pole in a rotational direction of the developer support, and creates a low magnetic area for separating the developer not used in the developing area from the developer support, the developing device further includes: a guide member that is disposed downstream of the supply space in the rotational direction of the developer support, with a gap from the developer support, thereby creating a guide channel for guiding the developer being fed thereto while being supported on the developer support; and a regulating member that is disposed downstream of the guide member and upstream of the developing area in the rotational direction, so as to be opposed to the developer support with a gap therefrom, thereby regulating the amount of the developer that has passed through the guide channel, the guide member further creates a reflux channel in a gap from an inner surface of the housing, the reflux channel is connected to the guide channel via a communication channel such that the developer regulated by the regulating member returns toward an upstream end of the guide member against the rotational direction, the upstream end of the guide member is disposed in a position opposed to the position where the magnetic flux density of the catch pole peaks or in a position upstream of the catch pole and downstream of the low magnetic area, and the magnet assembly further includes a feeding pole that is disposed downstream of the catch pole and upstream of the developing pole in the rotational direction, so as to be opposed to the guide channel.

A developing device according to another embodiment of the present invention for forming a toner image by developing an electrostatic latent image formed on an electrostatic image support using a developer, the device including: a housing that stores the developer; a developer support that is opposed to the electrostatic image support and rotates while supporting the developer supplied from the housing, thereby feeding the developer to a developing area opposed to the electrostatic image support; a guide member that is disposed downstream of a supply space in the housing from which the developer is supplied, in the rotational direction of the developer support, so as to be opposed to the developer support with a gap therefrom, such that the developer supported on the developer support passes through the gap; a regulating member that is disposed downstream of the guide member in the rotational direction, so as to be opposed to the developer support at a distance therefrom and with a gap from the developer support, thereby regulating the amount of the developer that has passed through the gap between the guide member and the developer support; and a magnet assembly that is fixed inside the developer support and has a plurality of magnetic poles, at least including a catch pole, a feeding pole, and a regulating pole arranged from upstream to downstream in the rotational direction, in which, the catch pole is approximately opposed to the supply space so as to attract the developer from the supply space onto the developer support, the feeding pole is disposed in a position opposed to the guide member, so as to be adjacently upstream of the regulating pole in the rotational direction, the regulating pole is approximately opposed to the regulating member, the guide member has an upstream end disposed downstream of a position where the magnetic flux density of the catch pole peaks, in the rotational direction, and upstream of or at a position where the feeding pole has a magnetic flux density of substantially zero, in the rotational direction, and a magnetic attractive force applied at the upstream end is lower than a magnetic attractive force in the gap between the developer support and the regulating member.

A developing device according to still another embodiment of the present invention for forming a toner image by developing an electrostatic latent image formed on an electrostatic image support using a developer, the device including: a housing that stores the developer; a developer support that is opposed to the electrostatic image support and rotates while supporting the developer supplied from the housing, thereby feeding the developer to a developing area opposed to the electrostatic image support; and a magnet assembly that is fixed inside the developer support and has a plurality of magnetic poles, at least including a catch pole, a charging pole, a regulating pole, and a developing pole, in which, the catch pole is opposed to a supply space in the housing from which the developer is supplied, so as to attract the developer from the supply space onto the developer support, the charging pole is disposed downstream of the catch pole in a rotational direction of the developer support, the regulating pole is disposed downstream of the charging pole in the rotational direction, the developing pole is disposed downstream of the regulating pole in the rotational direction so as to be opposed to the developing area, the developing device further includes: a guide member that is disposed downstream of the supply space in the rotational direction, so as to be opposed to the charging pole with a gap from the developer support, thereby creating a guide channel through which the developer supported on the developer support is fed; and a regulating member that is disposed downstream of the guide member in the rotational direction, so as to be opposed to the regulating pole with a gap from the developer support, thereby regulating the amount of the developer that has passed through the guide channel, the guide member further creates a reflux channel in a gap from an inner surface of the housing, the reflux channel is connected to the guide channel via a communication channel such that the developer regulated by the regulating member returns toward an upstream end of the guide member against the rotational direction, and the developing device further includes a shear force applying unit for applying a shear force to a top of the developer in the guide channel that is caused to spike by a magnetic force from the charging pole.

DETAILED DESCRIPTION OF THE PREFERRED EMBODIMENTS

Embodiment A

General Configuration of Image Forming Apparatus

Figure 1:
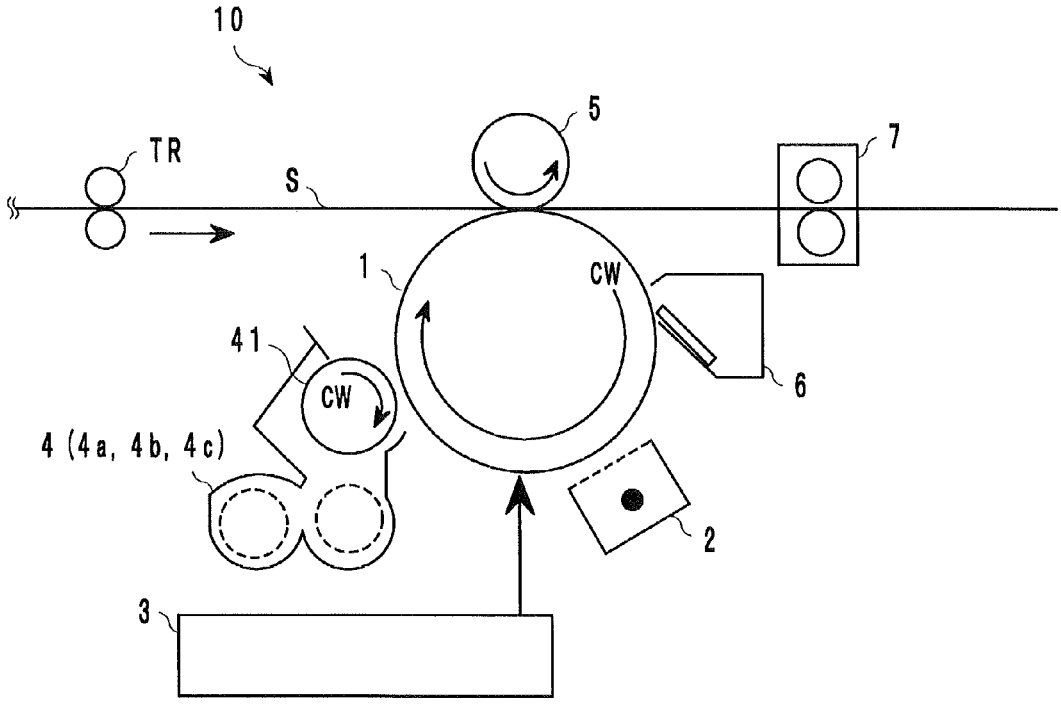
FIG. 1 is a schematic diagram illustrating an image forming apparatus to which developing devices according to embodiments of the present invention can be applied.

Described first is an image forming apparatus to which a developing device according to Embodiment A of the present invention can be applied. In FIG. 1, an image forming apparatus 10 is a printer for forming a monochrome image on a recording medium S such as recording paper, for example.

The image forming apparatus 10 includes a photoreceptor drum 1, which is a typical example of an electrostatic image support. The image forming apparatus 10 has a charger 2, an image exposing device 3, a developing device 4 (4*a*, 4*b*, or 4*c*), a transfer roller 5, and a cleaning device 6 arranged around the photoreceptor drum 1 in the same order. In addition, the image forming apparatus 10 includes a unit for supplying the recording medium S, and also includes a fusing device 7 and an output tray provided downstream of the transfer roller 5 in a direction in which the supply unit feeds the recording medium S. Note that reference characters 4*a*, 4*b*, and 4*c* denote developing devices according to first, second, and third embodiments to be described later. In addition, the supply unit and the output tray are not shown for convenience.

The photoreceptor drum 1 is, for example, a negatively chargeable photoreceptor whose surface can be uniformly charged to a predetermined negative potential by the charger 2.

The image exposing device 3 subjects an area of the photoreceptor which is being charged by the charger 2 to image exposure, thereby forming an electrostatic latent image in accordance with a desired image to be formed. Note that the image exposing device 3 performs the exposure on the basis of image information provided by an unillustrated image reading apparatus, computer, external facsimile, or the like.

The developing device 4 develops the electrostatic latent image on the photoreceptor drum 1 using a binary developer (simply referred to below as a "developer"), which includes toner and magnetic carrier. Here, for example, the toner is made by polymerization, has an average particle size of 6 μm, and is negatively charged for use. The magnetic carrier has an average particle size of 33 μm. The developing device 4 develops the electrostatic latent image through reversal development with the negatively charged toner, thereby forming a toner image. Note that the configuration of the developing device 4 will be described in detail later.

The image forming apparatus 10 thus configured forms a toner image on a recording medium S in the following manner. First, an unillustrated photoreceptor drive motor drives the photoreceptor drum 1 to rotate clockwise as indicated by arrow CW in FIG. 1 (referred to below as the "rotational direction CW"). The surface of the photoreceptor drum 1 is uniformly charged to a predetermined potential by the charger 2 to which charging bias is being applied. The image exposing device 3 exposes the charged area to light, thereby forming an electrostatic latent image on the surface of the photoreceptor drum 1 in accordance with a desired image to be formed. The developing device 4 develops the electrostatic latent image, thereby forming a toner image on the photoreceptor drum 1.

Furthermore, the recording medium S is supplied from the supply unit to a timing roller TR in FIG. 1. The timing roller TR adjusts the timing of the recording medium S being introduced to and passing through a transfer nip between the photoreceptor drum 1 and the transfer roller 5. At this time, the transfer roller 5 has a transfer voltage applied thereto by a transfer power source (not shown), so that the toner image on the photoreceptor drum 1 is transferred onto the recording medium S. The recording medium S having the toner image transferred thereon passes through the fusing device 7. The fusing device 7 heats and presses the recording medium S, so that the toner image is fixed on the recording medium S, which is ejected onto the output tray thereafter. After the toner image is transferred, the cleaning device 6 cleans the surface of the photoreceptor drum 1 for subsequent image formation.

First Embodiment

Figure 2:
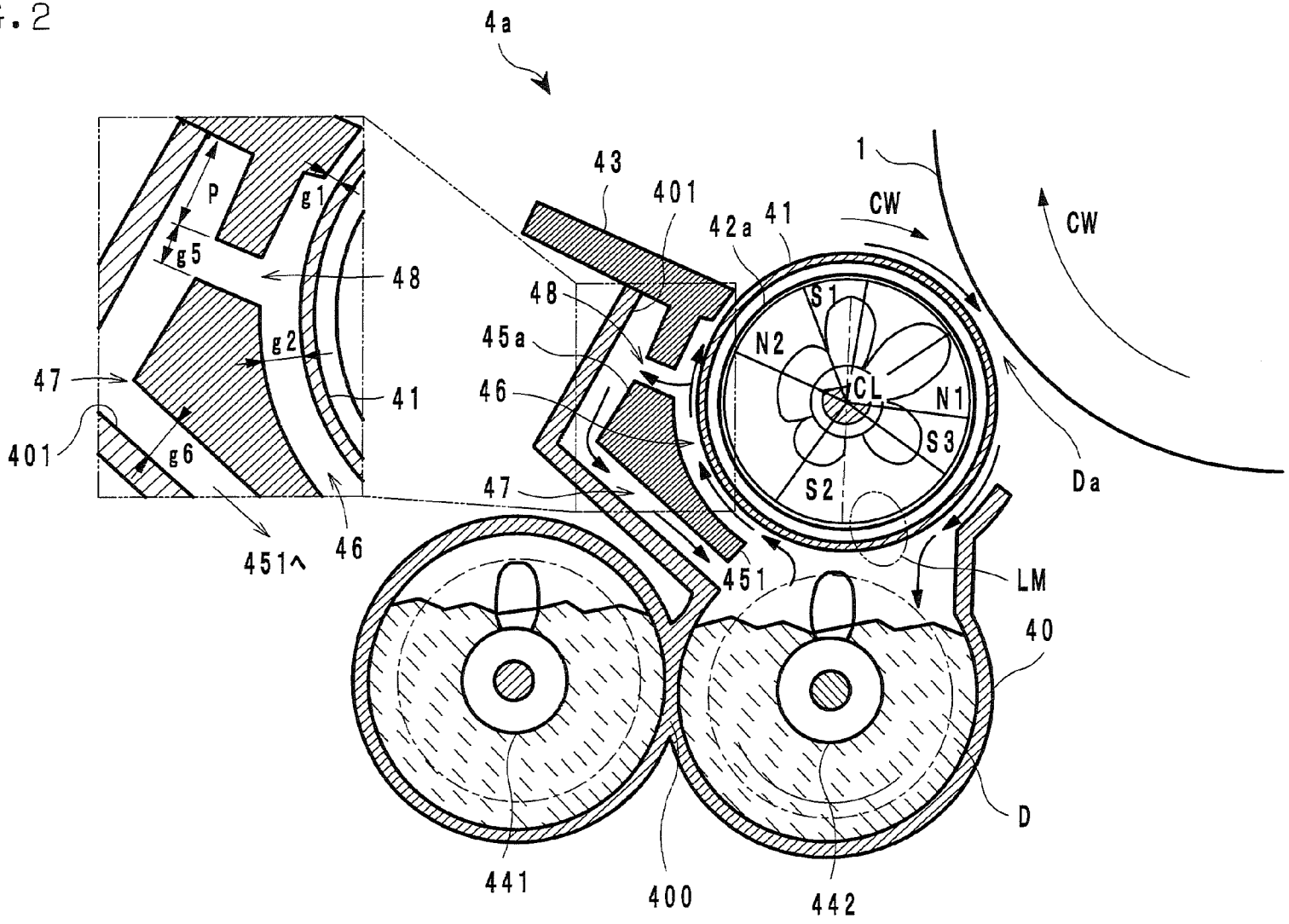
FIG. 2 is a vertical cross section schematically illustrating the configuration of a developing device according to a first embodiment.
Figure 3:
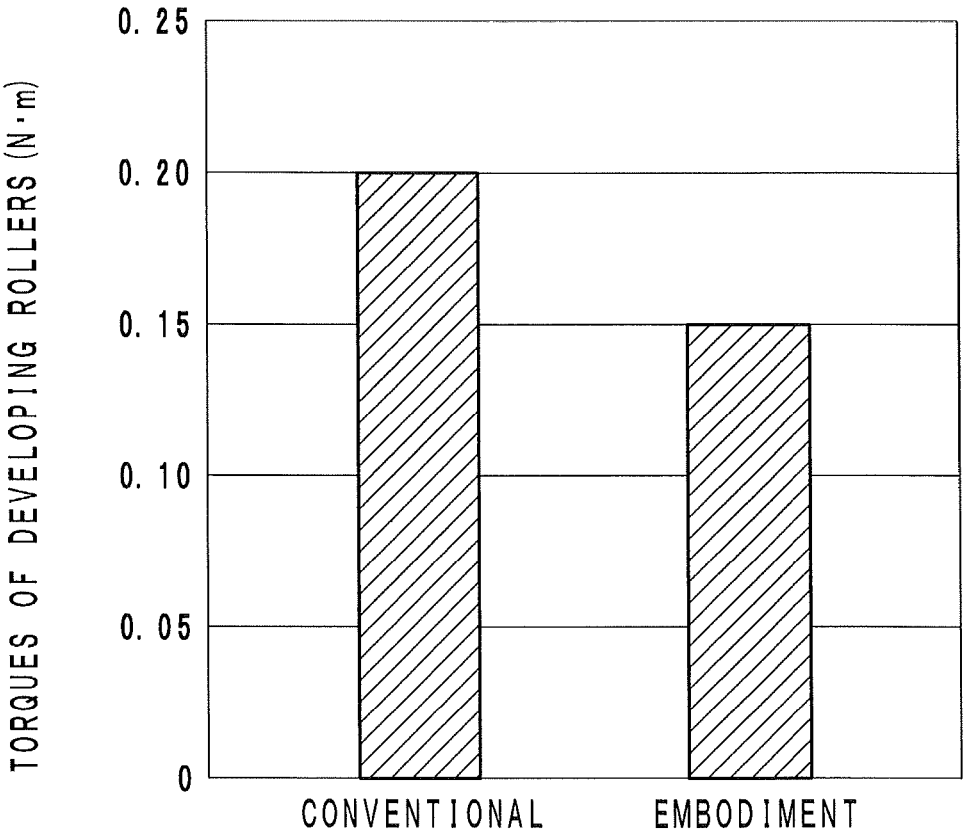
FIG. 3 is a graph showing measurement results for rotation torques of developing rollers in the developing device of FIG. 2 and a conventional developing device.
Figure 4:
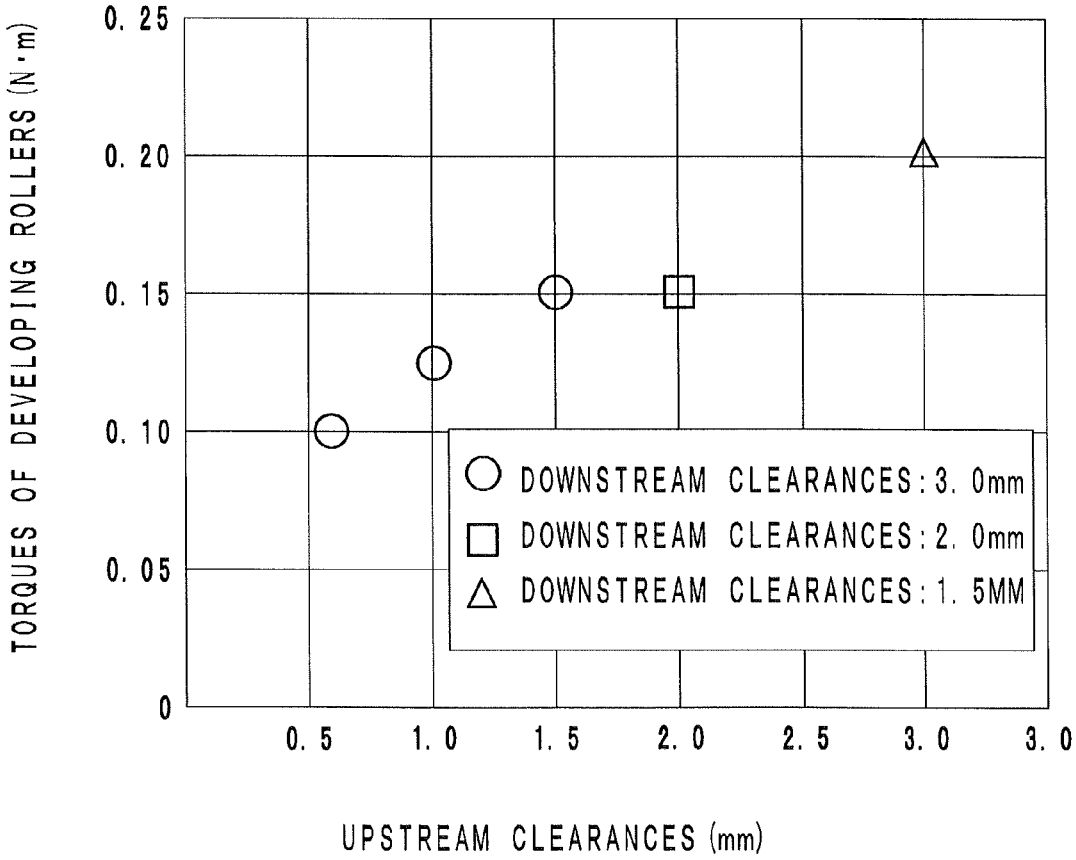
FIG. 4 is a graph showing effects of upstream and downstream clearances of a guide member on the rotation torque of the developing roller.

Next, referring to FIGS. 2 to 4, the developing device 4*a* of FIG. 1 will be described in detail. In FIG. 2, the developing device 4*a* includes a housing 40 for storing a developer D, a developing roller 41 rotatably attached to the housing 40, a magnet assembly 42*a* provided inside the developing roller 41, and a regulating member 43 provided close to the developing roller 41 with gap g1 therebetween for regulating the amount of developer D.

The developing roller 41 is a typical example of a developer support. The developing roller 41 is a sleeve-form non-magnetic member and is also called a "developing sleeve". The developing roller 41 has an outer circumferential surface roughened, for example, by blasting to a proper degree to feed the developer D. Moreover, the developing roller 41 has an outer diameter of 16 mm, for example.

The developing roller 41 is disposed in an opening provided in the housing 40 toward the photoreceptor drum 1, so as to be opposed to and spaced from the photoreceptor drum 1. Moreover, an unillustrated developing motor drives the developing roller 41 to rotate in the rotational direction CW in FIG. 2. Here, the width direction of the recording medium S is a direction perpendicular to a direction in which the recording medium S is fed for image formation. The developing roller 41 is formed so as to have its length direction along a center line of rotation CL so that the developing roller 41 can deal with recording media S of various width sizes.

The developing device 4 further includes a pair of developer feeding members 441 and 442. The developer feeding members 441 and 442 frictionally charge the toner by stirring the developer D in the housing 40, and feed the developer D along the longitudinal direction of the developing roller 41 (the direction of the center line of rotation CL), thereby distributing the developer D across the developing roller 41 on which the developer D is to be supported.

The developer feeding members 441 and 442 are disposed parallel to the developing roller 41 so as to be rotatable in the housing 40. In the present embodiment, the developer feeding members 441 and 442 are screw conveyors, and receive drive force from an unillustrated developing motor via a transmission mechanism. The drive force rotationally drives the developer feeding members 441 and 442.

The developer D is fed inwardly from the front of the sheet of FIG. 2 by the developer feeding member 441. Thereafter, the developer D moves to the other feeding member 442 through an opening (not shown) provided in a partition wall 400 between the feeding members 441 and 442, the opening being located on the other side viewed from the front of the sheet of FIG. 2. The feeding member 442 feeds the developer D outwardly from the inside, so that the developer D moves to the feeding member 441 through another opening provided in the partition wall 400, the opening being located on the front side of the sheet of FIG. 2. In this manner, the developer D is circulated within the housing 40.

The feeding member 442, which faces the developing roller 41, feeds the developer D along the longitudinal direction of the developing roller 41, and distributes the developer D across the developing roller 41. An additional supply of toner is provided, for example, from behind the feeding member 441 when viewed from the front of the sheet of FIG. 2.

The magnet assembly 42*a* attracts the developer D in a supply space in the housing 40 onto the surface of the developing roller 41. Moreover, the magnet assembly 42*a* creates a low magnetic area LM (see a portion enclosed by long dashed double-short dashed lines in the figure) in which the developer D that remains attracted onto the surface of the developing roller 41 without being transferred to the surface of the photoreceptor drum 1 is separated from the surface of the developing roller 41.

More specifically, for example, the magnet assembly 42*a* is formed in the shape of a roll by arranging a combination of permanent magnets, such that S and N poles of the magnets are provided along the circumference of the magnet assembly 42*a*.

The magnetic poles of the magnet assembly 42*a* are a catch pole S2, a regulating pole N2, a feeding pole S1, a developing pole N1, and a separating pole S3. Note that "S" and "N" included in the reference characters denote S and N poles. The catch pole S2 initially attracts the developer D from the supply space in the housing 40 onto the surface of the developing roller 41. The regulating pole N2 is disposed in a position opposed to the regulating member 43. The feeding pole S1 is a magnetic pole for feeding the developer D that has passed through gap g1 with the regulating member 43, to a developing area Da where an electrostatic latent image on the photoreceptor drum 1 is developed. Moreover, the developing pole N1 is disposed in a position opposed to the developing area Da. The separating pole S3 is disposed between the developing pole N1 and the catch pole S2, and creates a repelling magnetic field therebetween, thereby creating a low magnetic area LM with a magnetic flux density of, for example, 5 mT or less. Note that the arrangement of the magnetic poles in the magnet assembly 42*a* is not limited to the above, and the magnetic poles may be arranged in different patterns.

The developing device 4*a* further includes a guide member 45*a* disposed upstream of the regulating member 43 in the rotational direction CW of the developing roller 41. The guide member 45*a* is made of a non-magnetic material and positioned between the developing roller 41 and an inner surface 401 of the housing 40.

The guide member 45*a* is separated from the developing roller 41 by gap g2. Provided between the guide member 45*a* and the developing roller 41 is a guide channel 46 for leading the developer D into gap g1.

Furthermore, the guide member 45*a* is separated from the inner surface 401 by gap g6. Provided between the guide member 45*a* and the inner surface 401 is a reflux channel 47 for causing the developer D to flow toward an upstream end 451 of the guide member against the rotational direction CW.

Furthermore, there is provided a communication channel 48 with a size of gap g5 at an end of the guide member 45*a* that is downstream of the rotational direction CW, specifically, the end being proximal to the regulating member 43 (in this example, a position at distance P upstream from the regulating member 43), and the communication channel 48 allows the guide channel 46 to communicate with the reflux channel 47.

Furthermore, the upstream end 451 is positioned so as to face a position in which the magnetic flux density of the magnetic pole that is closest to the low magnetic area LM on the downstream side (in the present embodiment, the catch pole S2) peaks. Note that in the present embodiment, the magnetic flux density Br of the catch pole S2 in the radial direction of the developing roller 41 is assumed to be 45 mT on the surface of the developing roller 41.

The surface of the guide member 45*a* that is opposed to the developing roller 41 desirably has satisfactory smoothness provided by, for example, fluororesine coating or suchlike.

Here, gap g1 is, for example, 0.5 mm, gap g2 is, for example, 1.5 mm, gap g6 is, for example, 2.0 mm, distance P is, for example, 3.0 mm, and gap g5 is, for example, 1.5 mm.

With the developing device 4*a*, the developer D being attracted onto the surface of the developing roller 41 via magnetic force applied by the catch pole S2 of the magnet assembly 42*a* is fed toward gap g1 under action of frictional force through rotation of the developing roller 41. The amount of developer D is regulated by gap g1, and thereafter, the developer D that has passed through gap g1 is supplied to the developing area Da in a spiked form to be used to develop an electrostatic latent image formed on the photoreceptor drum 1. In addition, the developer D not used for the developing returns to the housing 40 while being held on the developing roller 41, and falls from the developing roller 41 in the low magnetic area LM.

It should be noted here that, with the developing device 4*a*, the amount of the developer D that is supplied to the developing roller 41 is limited so as not to be excessive by the upstream end 451 of the guide member 45*a*. Moreover, the upstream end 451 of the guide member 45*a* is positioned so as to correspond to a position where the magnetic flux density of the magnetic pole S2, which is closest to the low magnetic area LM on the downstream side, peaks. Therefore, the force of attracting the developer D onto the developing roller 41 is relatively low near the upstream end 451, so that stress on the developer D is kept low near the upstream end 451.

Furthermore, the guide member 45*a* creates the guide channel 46 and the reflux channel 47 as passages for the developer D, both of which are immediately upstream of the regulating member 43. The guide channel 46 is a space created between the developing roller 41 and the guide member 45*a*. In the guide channel 46, the developer D is fed in the same direction as the rotational direction CW of the developing roller 41. In addition, the reflux channel 47 is a space created between the guide member 45*a* and the housing 40. In the reflux channel 47, the developer D moves against the rotational direction CW. Specifically, the developer D that has been hindered by the regulating member 43 from being fed to the developing area Da flows from the guide channel 46 into the reflux channel 47 via the communication channel 48. Thereafter, the developer D moves toward the upstream end 451 of the guide member 45*a* in accordance with gravity.

Here, since the guide member 45*a* limits the clearance from the surface of the developing roller 41, the developer D being fed through the guide channel 46 is accumulated immediately before the regulating member 43 in a larger amount than in the case where the guide member 45*a* is not provided.

Furthermore, the pressure being applied to the developer D immediately before the regulating member 43 is canceled by the communication channel 48, and the developer D failing to pass through gap g1 is caused to return toward the upstream end 451 through the reflux channel 47, so that the pressure on the developer D can be prevented from becoming excessively high immediately before the regulating member 43.

In this manner, with the developing device 4*a*, the amount of the developer D that is accumulated immediately before the regulating member 43 can be reduced while minimizing stress on individual particles included in the developer D, so that stress applied to the developer D immediately before the regulating member 43 can be reduced.

Furthermore, since the developing device 4*a* minimizes the accumulation of the developer D immediately before the regulating member 43, the developer D failing to pass the regulating member 43 can be inhibited from being rubbed against the developing roller 41 (i.e., rubbing reaction force can be inhibited from being applied to the developing roller 41), resulting in the advantage of being able to keep the rotation torque of the developing roller 41 low.

In the above embodiment, the upstream end 451 is disposed in a position opposed to the position where the magnetic flux density of the catch pole S2 peaks. However, this is not restrictive, and the upstream end 451 may be positioned upstream of the catch pole S2 and downstream of the low magnetic area LM, so long as the developer D can be attracted onto the surface of the developing roller 41.

Furthermore, in the present embodiment, gap g2 has been described as being set at 1.5 mm. However, gap g2 does not have to be 1.5 mm uniformly across the entire reflux channel 47. For example, to inhibit clogging of the developer D, the gap may be smaller on the upstream side of the reflux channel 47 than on the downstream side.

Figure 26:
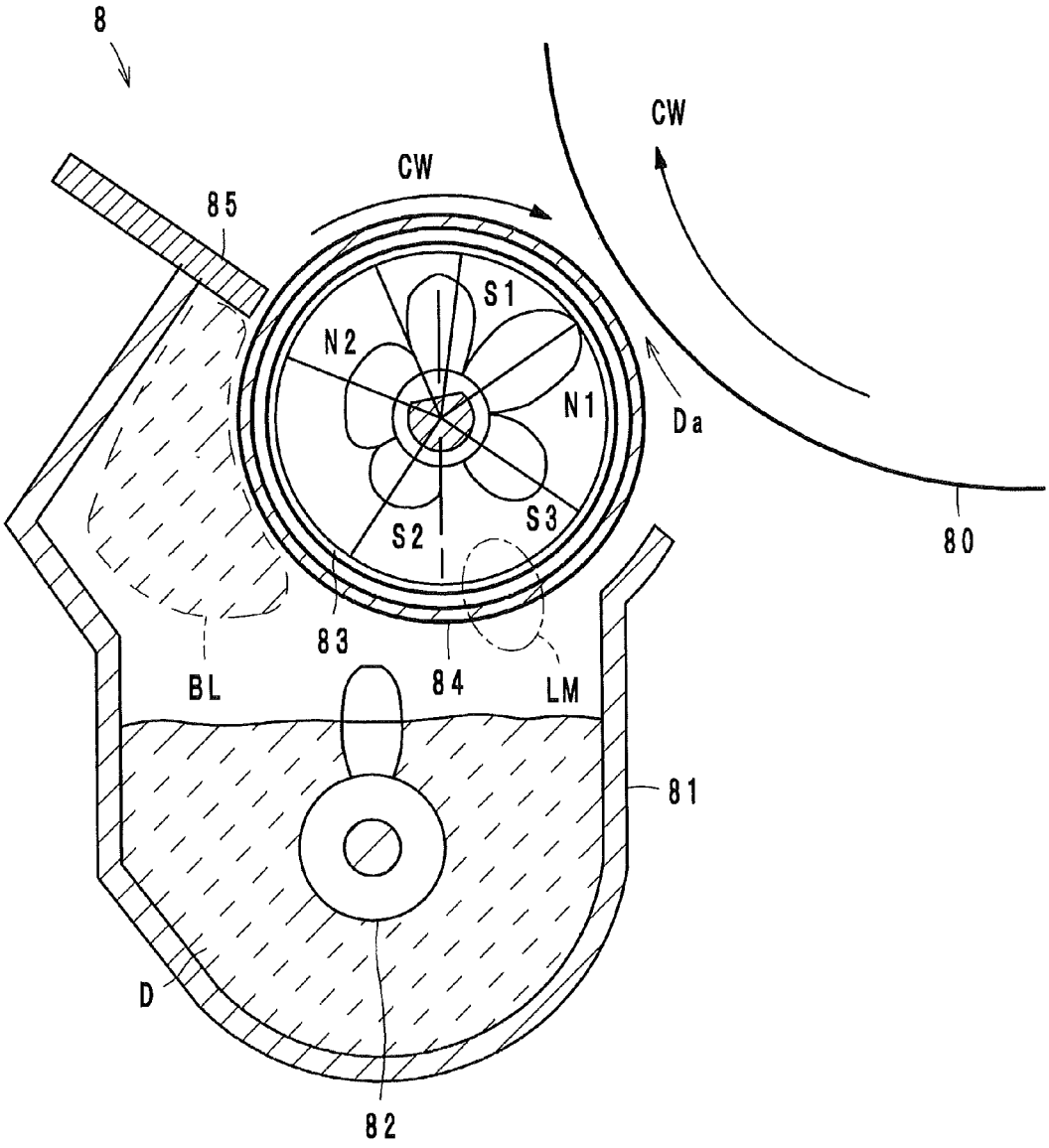
FIG. 26 is a vertical cross section illustrating an example of a conventional developing device.
Figure 27:
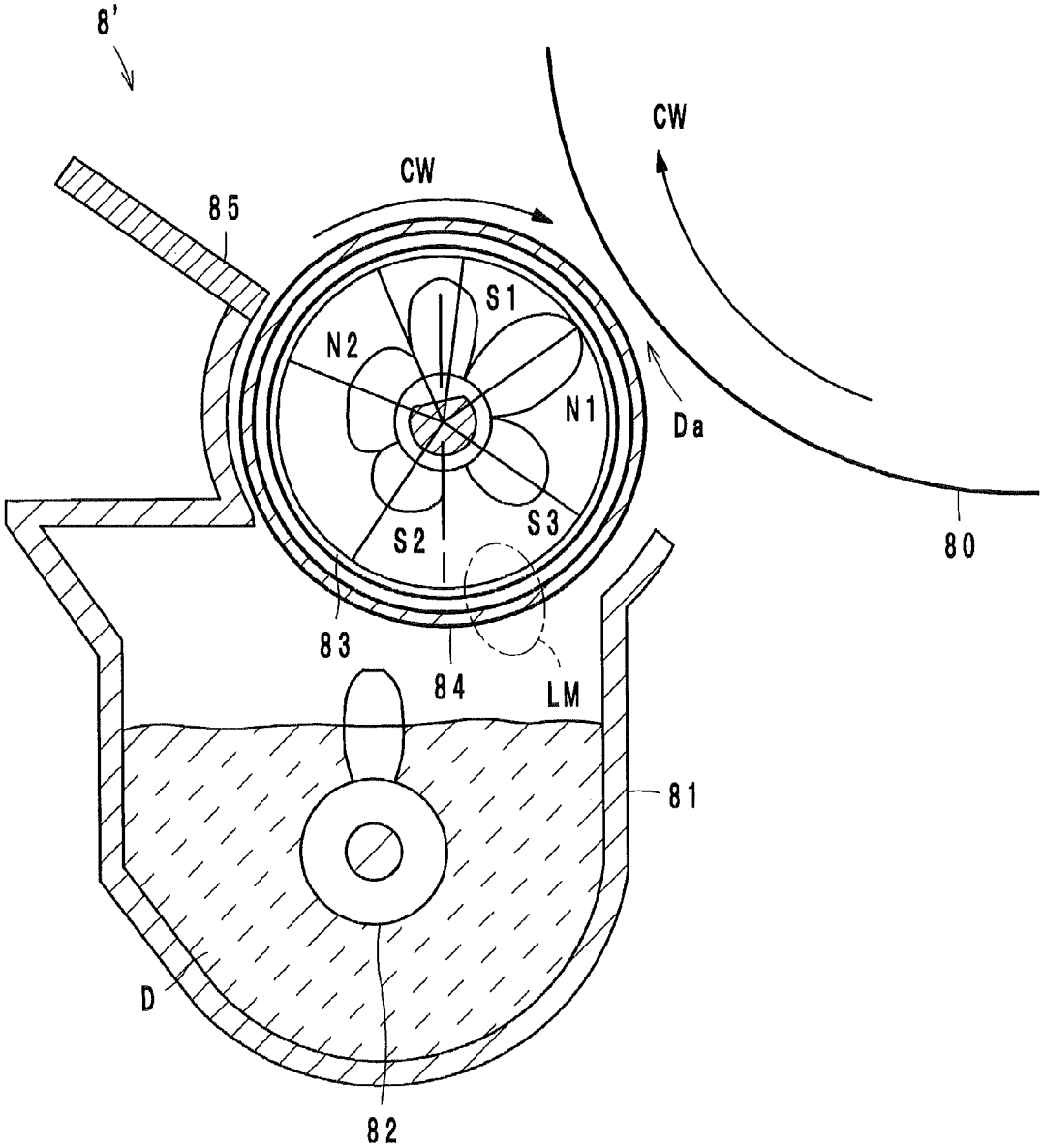
FIG. 27 is a vertical cross section illustrating another example of a conventional developing device.

Furthermore, the present inventors measured the developing roller of the developing device 4*a* and the developing roller of the conventional developing device 8 (see FIG. 26) for their rotation torques. The developing devices 4*a* and 8 were measured under the same conditions in terms of their developing rollers, magnet assemblies, regulating members, etc., and the circumferential speed of each developing roller was set at 302 mm/second.

As the amount of the developer that is accumulated immediately before the regulating member increases, the force of rubbing the developer against the developing roller increases, resulting in an increased rotation torque of the developing roller. However, as shown in FIG. 3, in the conventional developing device 8, the rotation torque of the developing roller is 0.20 N·m, whereas in the developing device 4*a*, the rotation torque of the developing roller is 0.15 N·m. Accordingly, the rotation torque of the developing device 4*a* is reduced by about 20% from that of the conventional developing device 8. It can be appreciated that with the developing device 4*a*, the amount of the developer that is accumulated immediately before the regulating member is kept low, and further, stress on the developer is also kept low, as described above.

Furthermore, the present inventors measured the developing device 4*a* for the rotation torque of the developing roller where the gap (downstream clearance) between the downstream end of the guide member 45*a* and the surface of the developing roller 41 was 1.5 mm, and the gap (upstream clearance) between the upstream end of the guide member 45*a* and the surface of the developing roller 41 was changed among 0.6 mm, 1.0 mm, and 1.5 mm. Likewise, measurements for the rotation torque of the developing roller were carried out where each of the downstream and upstream clearances was 2.0 mm and thereafter 3.0 mm. The measurement results are shown in FIG. 4. It can be appreciated from FIG. 4 that when the clearance between the guide member 45*a* and the developing roller is approximately 2 mm or less, a rotation torque of 0.15 N·m can be achieved, which is lower than conventional. Note that the developing device 4*a* may have the guide member 45*a* integrated with the housing 40 for the purpose of reducing the number of parts.

Second Embodiment

Figure 5:
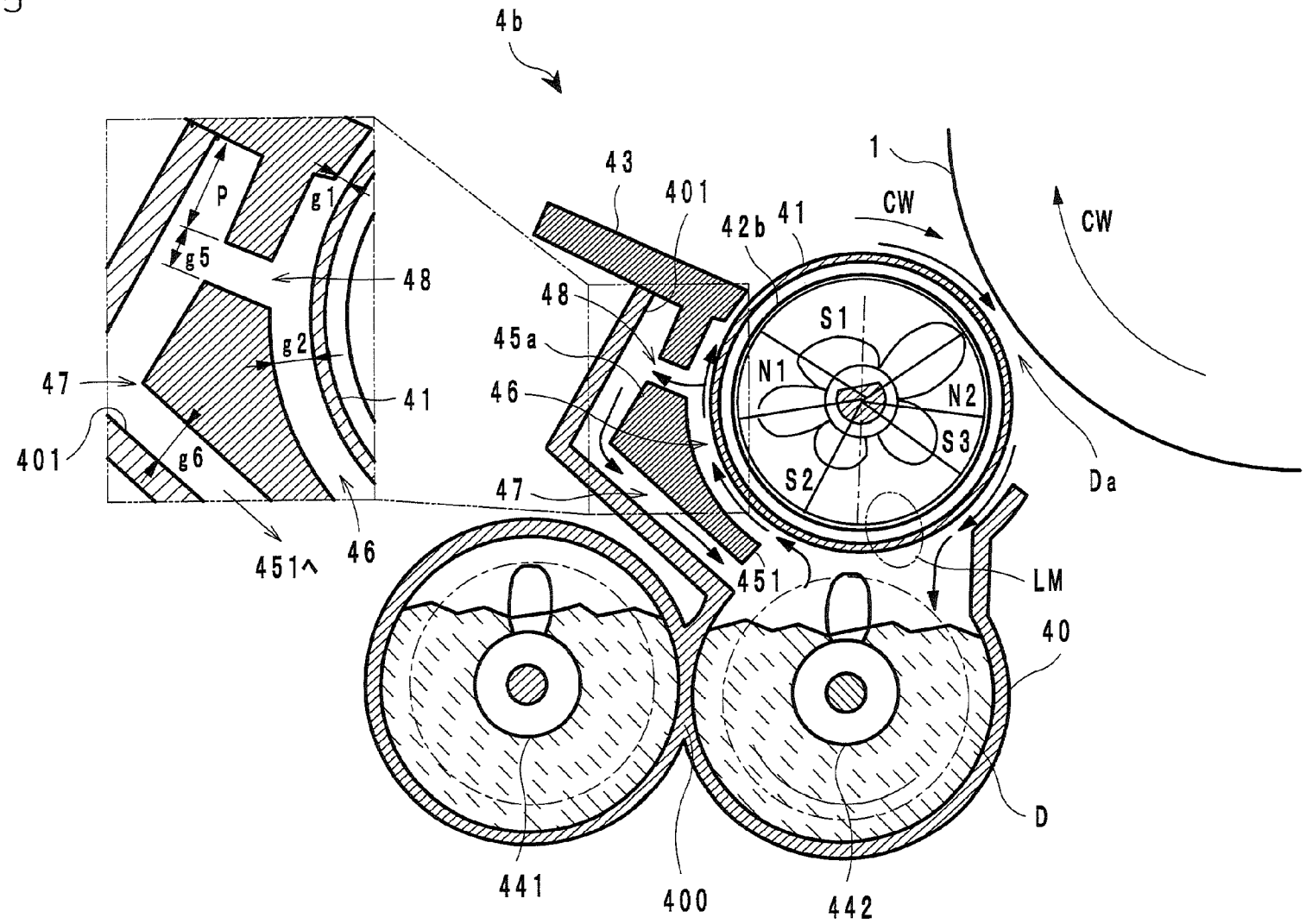
FIG. 5 is a vertical cross section schematically illustrating the configuration of a developing device according to a second embodiment.

FIG. 5 is a vertical cross section schematically illustrating the configuration of the developing device 4*b* of FIG. 1. In FIG. 5, the developing device 4*b* differs from the developing device 4*a* in that a magnet assembly 42*b* is provided in place of the magnet assembly 42*a*. There is no other difference between the developing devices 4*a* and 4*b*. Therefore, in FIG. 5, elements corresponding to those in FIG. 2 are denoted by the same reference characters, and any descriptions thereof will be omitted.

As with the magnet assembly 42*a*, the magnet assembly 42*b* is formed in the shape of a roll by arranging a combination of permanent magnets, for example, but the magnet assembly 42*b* differs from the magnet assembly 42*a* in the arrangement of magnetic poles on the circumferential surface. The magnet assembly 42*b* has a catch pole S2, a feeding pole N1, a regulating pole S1, a developing pole N2, and a separating pole S3 provided on the circumferential surface. As described in the earlier embodiment, the catch pole S2 attracts the developer D in the housing 40 onto the surface of the developing roller 41. The feeding pole N1 is a magnetic pole positioned so as to be opposed to the guide channel 46 and feed the developer D passing through the guide channel 46 to the regulating member 43. The regulating pole S1, the developing pole N1, and the separating pole S3 function basically in the same manner as the regulating pole N1, the developing pole N1, and the separating pole S3 in the first embodiment, and therefore any descriptions thereof will be omitted.

In the first embodiment, the regulating pole N2 is provided immediately downstream of the catch pole S2. The catch pole S2 is provided so as to be opposed to the upstream end 451 of the guide member 45*a* or provided upstream thereof. The regulating pole N2 is provided so as to be opposed to the regulating member 43. Therefore, there might be a significant distance between the catch pole S2 and the regulating pole N2. In such a case, a frictional force required for feeding the developer D might be difficult to obtain. On the other hand, in the second embodiment, the feeding pole N1 is provided between the catch pole S2 and the regulating pole S1 so as to be opposed to the guide channel 46, so that a frictional force required for feeding through the guide channel 46 can be applied to the developer D.

Third Embodiment

Figure 6:
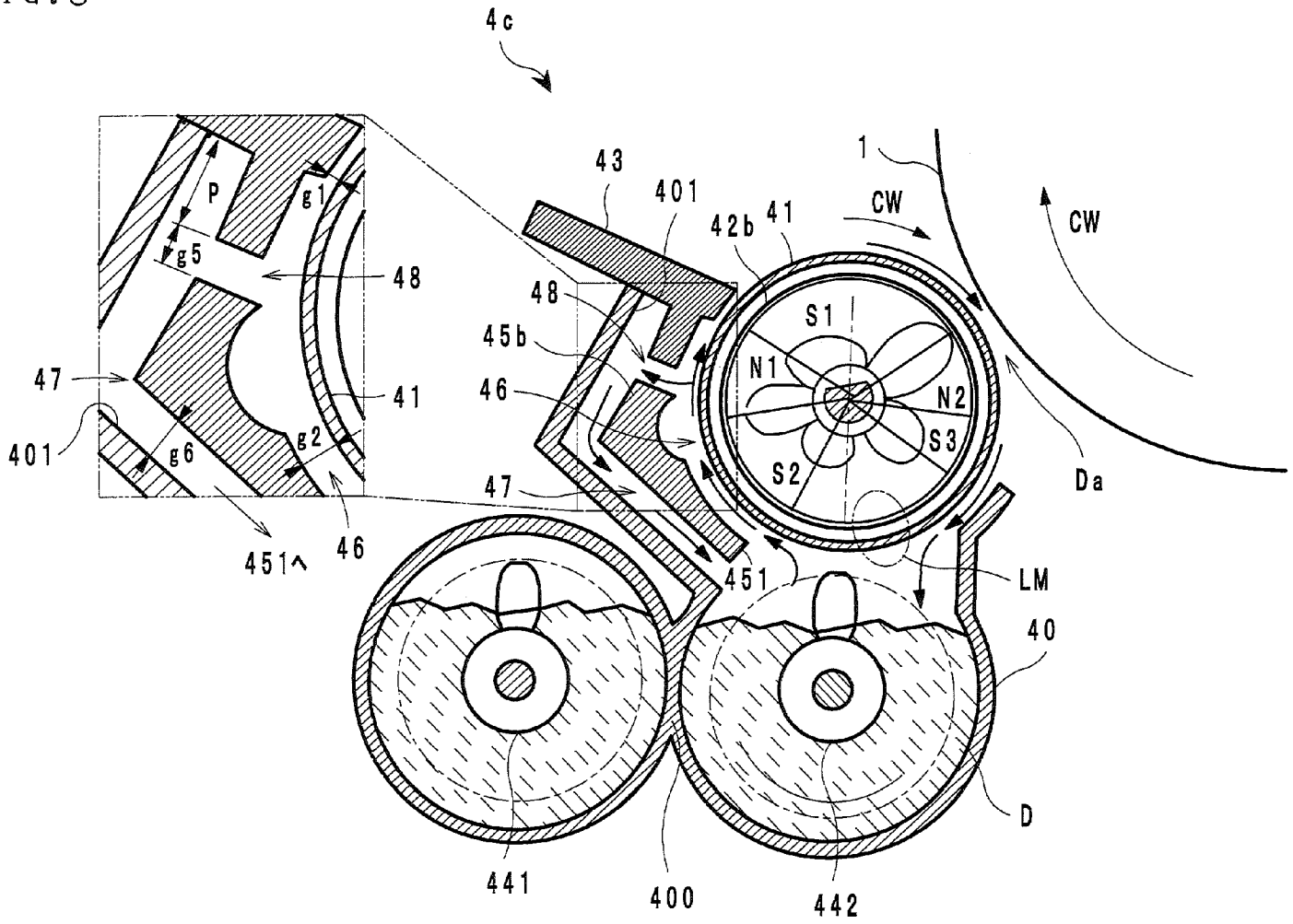
FIG. 6 is a vertical cross section schematically illustrating the configuration of a developing device according to a third embodiment.

FIG. 6 is a vertical cross section schematically illustrating the configuration of the developing device 4*c* of FIG. 1. In FIG. 6, the developing device 4*c* differs from the developing device 4*b* in that a guide member 45*b* is provided in place of the guide member 45*a*. There is no other difference between the developing devices 4*b* and 4*c*. Therefore, in FIG. 6, elements corresponding to those in FIG. 5 are denoted by the same reference characters, and any descriptions thereof will be omitted.

The cross-sectional shape of the guide member 45*b* is determined on the basis of the spiked shape of the developer D passing through the guide channel 46. In a specific example of the cross-sectional shape, the gap between the guide member 45*b* and the developing roller 41 is the widest in a position where the developer D spikes most in the guide channel 46. Preferably, the width of the gap is selected to be a value not causing the developer D spiking in the guide channel 46 to be rubbed against the guide member 45*b*.

In the second embodiment, the feeding pole N1 is provided so as to be opposed to the guide channel 46, and if the feeding pole N1 has an excessively high magnetic flux density, the developer D spiking in the guide channel 46 is stressed by being rubbed against the guide member 45*a*. In the third embodiment, to prevent such stress, for example, the guide member 45*b* is formed to have an arc-like cross-sectional shape on the basis of the spiked shape of the developer D.

Evaluation Results for Second and Third Embodiments

The present inventors observed the developer D spiking in the guide channel 46 for each of the developing devices 4*b* and 4*c* under the following conditions. Here, the developer D used was as shown below.

Carrier: a ferrite core coated with a thin resin film, average particle size of 33 μm (magnetization of 40 emu/g)

Toner: average particle size of 6 μm

Toner to carrier ratio (T/C ratio): 7%

Figure 7A:
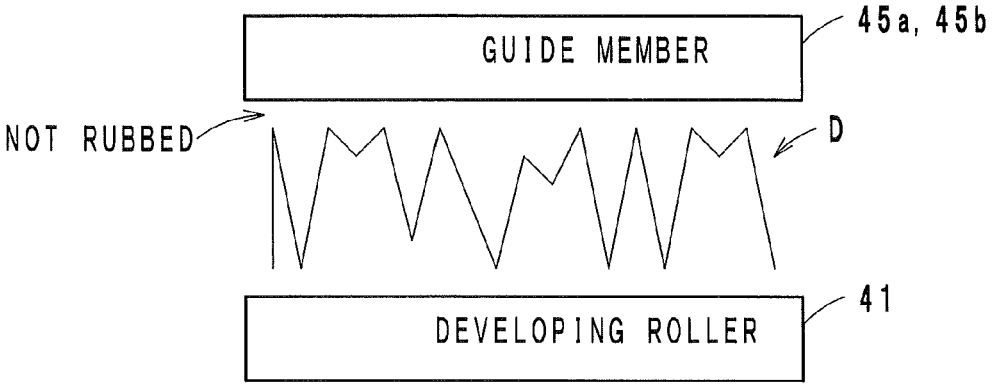
FIG. 7A is a schematic diagram illustrating a spiking developer not being rubbed against the guide member.
Figure 7B:
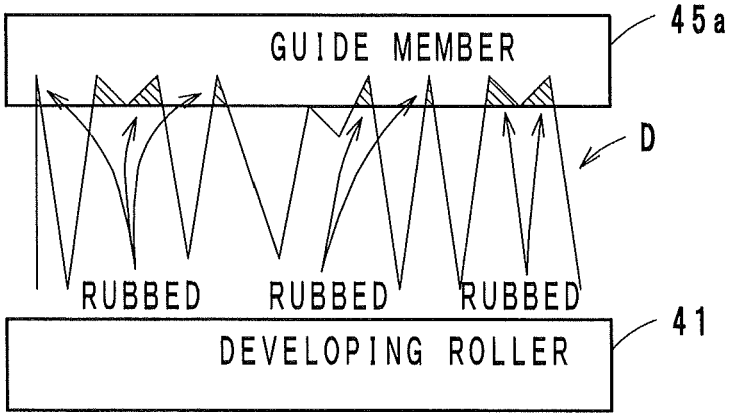
FIG. 7B is a schematic diagram illustrating a spiking developer being rubbed against the guide member.

To evaluate the developing device 4*b*, the present inventors initially set gap g2 between the guide member 45*a* and the developing roller 41 at 0.8 mm, and observed the developer D spiking in the guide channel 46 while changing the magnetic flux density of the feeding pole N1 among 30 mT, 40 mT, 50 mT, and 60 mT. For 30 mT and 40 mT, the developer D did not spike to such an extent as to contact the guide member 45*a*, as shown in FIG. 7A. On the other hand, for 40 mT and 50 mT, the developer D spiked to such an extent as to be rubbed against the guide member 45*a*, as shown in FIG. 7B.

Furthermore, to evaluate the developing device 4*c*, the present inventors set the gap between the guide member 45*b* and the developing roller 41 to be 1.2 mm in the position where the developer D spikes most in the guide channel 46, and observed the developer D spiking in the guide channel 46 while changing the magnetic flux density of the feeding pole N1 to 60 mT. In this case, the developer D did not spike to such an extent as to contact the guide member 45*b*, as shown in FIG. 7A.

Furthermore, the present inventors carried out endurance tests using the developing devices 4*b* and 4*c*, and thereafter evaluated toner fogging and scattering, where the CW (color white ratio) ratio was 5% and two hundred thousand sheets were continuously printed for each test. The results are shown in Table 1.

TABLE 1

| | feeding pole | carrier | | | |
|---|---|---|---|---|---|
| developing device | N1 magnetic flux density (mT) | mag-netization (emu/g) | average particle size (μm) | rubbed | toner fogging or toner scattering |
| developing device 4b | 30 | 40 | 33 | not rubbed | not occurred |
| | 40 | 40 | 33 | not rubbed | not occurred |
| | 40 | 30 | 25 | not rubbed | not occurred |
| | 40 | 60 | 25 | not rubbed | not occurred |
| | 40 | 30 | 37 | not rubbed | not occurred |
| | 40 | 60 | 37 | not rubbed | not occurred |
| | 50 | 40 | 33 | rubbed | occurred |
| | 60 | 40 | 33 | rubbed | occurred |
| developing device 4c | 60 | 40 | 33 | not rubbed | not occurred |
| | 60 | 30 | 25 | not rubbed | not occurred |
| | 60 | 60 | 25 | not rubbed | not occurred |
| | 60 | 30 | 37 | not rubbed | not occurred |
| | 60 | 60 | 37 | not rubbed | not occurred |

Note that Table 1 also shows evaluation results for developers D containing either of the following two carriers A and B different in average particle size and magnetic force.
Carrier A: an average particle size of 25 μm (magnetization of 30 emu/g or 60 emu/g)
Carrier B: an average particle size of 37 μm (magnetization of 30 emu/g or 60 emu/g)

In the case where the developers D containing either carrier A or B were used, if the developers D were not rubbed against the guide member 45*a* or 45*b*, neither toner fogging nor toner scattering was confirmed to occur.

Note that in each of the above embodiments, the image forming apparatus 10 has been described as forming a monochrome image. However, this is not restrictive, and the developing devices 4*a* to 4*c* may be employed in image forming apparatuses for color image formation. Moreover, in such a case, for example, the image forming apparatus includes developing devices for four colors yellow, magenta, cyan, and black, and at least one of the developing devices is the developing device described in the present embodiment.

Furthermore, since the image forming apparatus 10 includes any of the developing devices 4*a* to 4*c*, stress on the developer can be minimized, and further, deterioration of the developer can be reduced. Thus, occurrence of an image defect or suchlike can be inhibited, making it possible to provide an image forming apparatus 10 capable of forming a satisfactory image.

Embodiment B

General Configuration of Image Forming Apparatus

Figure 8:
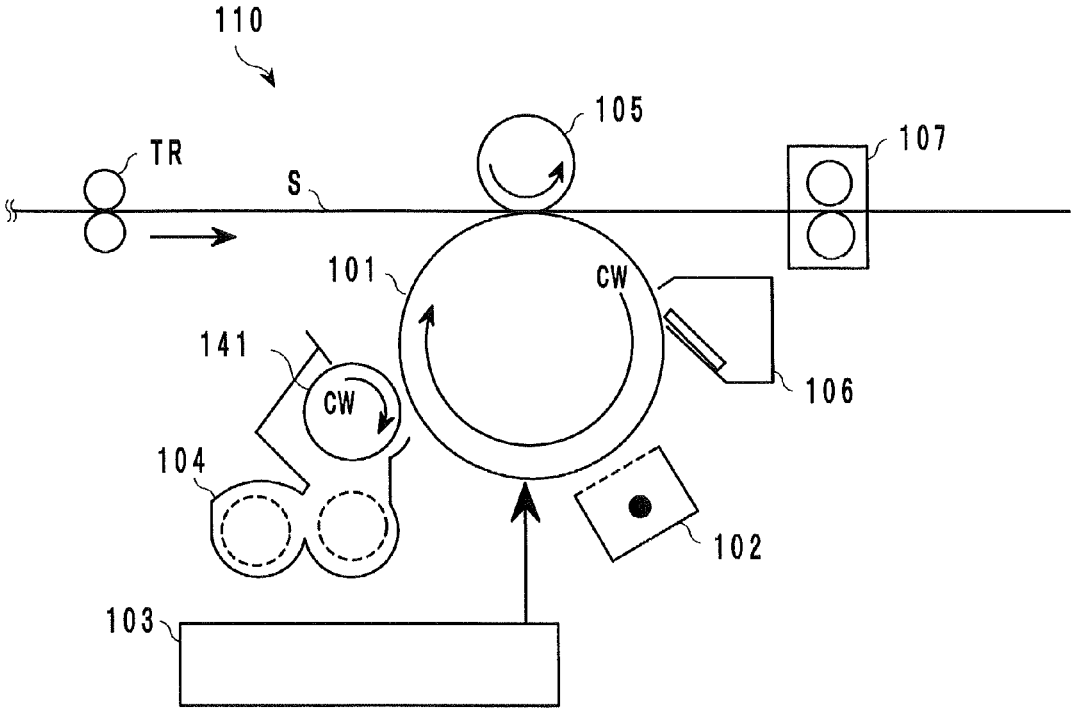
FIG. 8 is a schematic diagram illustrating an image forming apparatus to which a developing device according to an embodiment of the present invention can be applied.

Described first is an image forming apparatus to which a developing device according to Embodiment B of the present invention can be applied. In FIG. 8, an image forming apparatus 110 is, for example, a printer for forming a monochrome image on a recording medium S such as recording paper.

The image forming apparatus 110 includes a photoreceptor drum 101, which is a typical example of an electrostatic image support. The image forming apparatus 110 has a charger 102, an image exposing device 103, a developing device 104, a transfer roller 105, and a cleaning device 106 arranged around the photoreceptor drum 101 in the same order. In addition, the image forming apparatus 110 includes a unit for supplying the recording medium S, and also includes a fusing device 107 and an output tray provided downstream of the transfer roller 105 in a direction in which the supply unit feeds the recording medium S. Note that the supply unit and the output tray are not shown for convenience.

The photoreceptor drum 101 is, for example, a negatively chargeable photoreceptor whose surface can be uniformly charged to a predetermined negative potential by the charger 102.

The image exposing device 103 exposes to light the surface of the photoreceptor drum 101 being charged by the charger 102, on the basis of input image information, thereby forming an electrostatic latent image on that surface. Note that the image information is transmitted by an unillustrated image reading apparatus, computer, external facsimile, or suchlike.

The developing device 104 uses a binary developer (simply referred to below as a "developer") including toner and magnetic carrier, to develop the electrostatic latent image on the photoreceptor drum 101. Here, the toner is, for example, a negatively chargeable toner made by polymerization and having an average particle size of 6 μm. Moreover, the magnetic carrier has an average particle size of 33 μm. The developing device 104 forms a toner image by developing the electrostatic latent image through reversal development using the negatively charged toner. Note that the configuration of the developing device 104 will be described in detail later.

The image forming apparatus 110 thus configured forms a toner image on a recording medium S in the following manner. First, an unillustrated photoreceptor drive motor drives the photoreceptor drum 101 to rotate clockwise as indicated by arrow CW in FIG. 8 (referred to below as the "rotational direction CW"). The surface of the photoreceptor drum 101 is uniformly charged to a predetermined potential by the charger 102 to which charging bias is being applied. The image exposing device 103 exposes the charged area to light, thereby forming an electrostatic latent image on the surface of the photoreceptor drum 101 on the basis of input image information. The developing device 104 develops the electrostatic latent image, thereby forming a toner image on the photoreceptor drum 101.

Furthermore, the recording medium S is supplied from the supply unit to a timing roller TR in FIG. 8. The timing roller TR adjusts the timing of the recording medium S being introduced to and passing through a transfer nip between the photoreceptor drum 101 and the transfer roller 105. At this time, the transfer roller 105 has applied thereto a transfer voltage from a transfer power source (not shown), so that the toner image on the photoreceptor drum 101 is transferred onto the recording medium S. The recording medium S having the toner image transferred thereon passes through the fusing device 107. The fusing device 107 heats and presses the recording medium S, thereby fixing the toner image on the recording medium S, which is ejected onto the output tray thereafter. After the toner image is transferred, the cleaning device 106 cleans the surface of the photoreceptor drum 101 for subsequent image formation.

Configuration of Developing Device

Figure 9A:
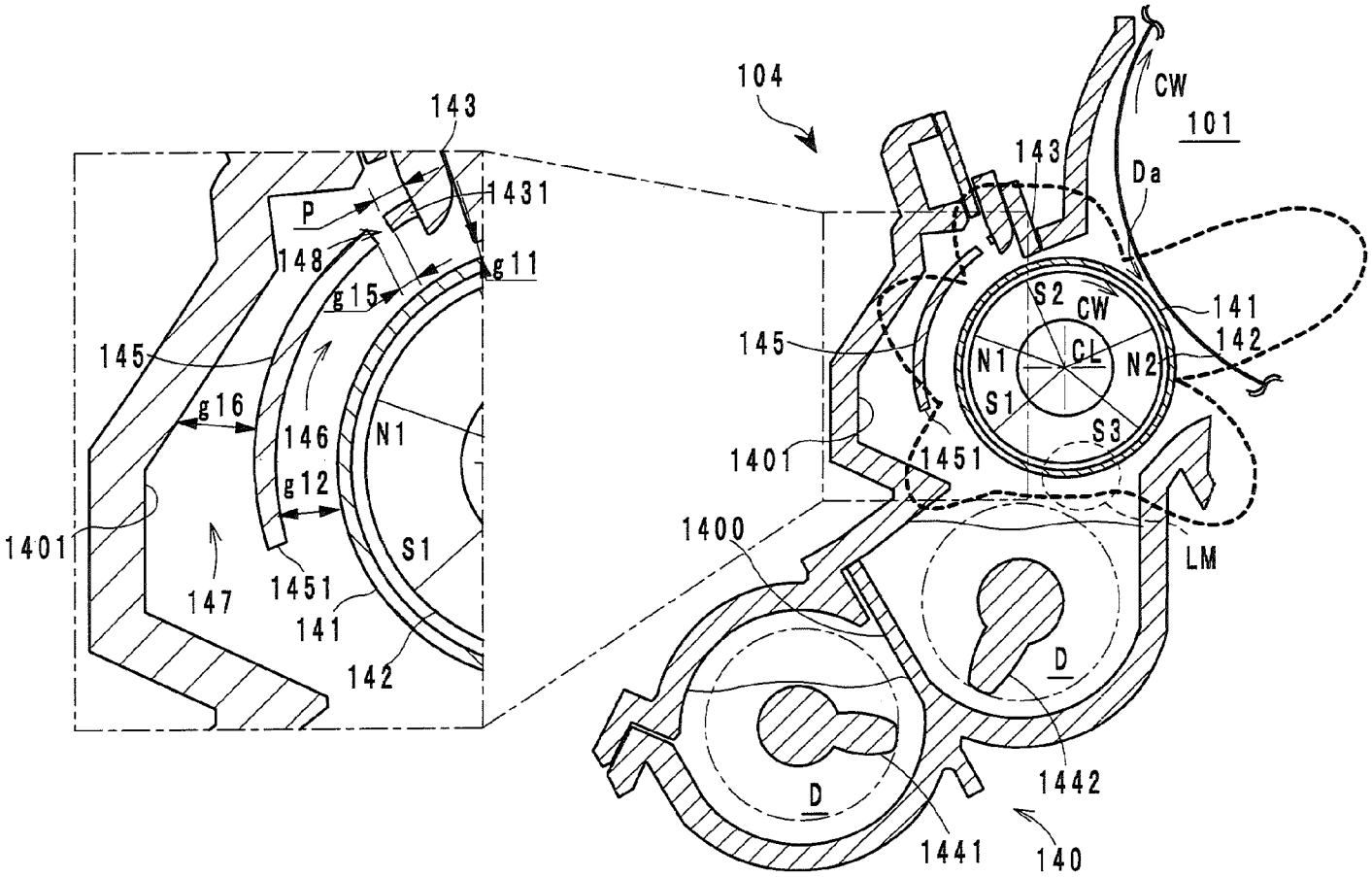
FIG. 9A is a vertical cross section schematically illustrating the configuration of the developing device according to the embodiment.

Next, referring to FIGS. 9A through 16, the developing device 104 of FIG. 8 will be described. In FIG. 9A, the developing device 104 includes a housing 140, a developing roller 141, a magnet assembly 142, and a regulating member 143.

The developing roller 141 is a typical example of a developer support. The developing roller 141 is a cylindrical sleeve made of a non-magnetic material and having an outer diameter of, for example, 16 mm. The developing roller 141 has an outer circumferential surface roughened, for example, by blasting to a proper degree to feed the developer D.

Furthermore, the developing roller 141 is disposed in an opening provided in the housing 140 toward the photoreceptor drum 101, so as to be opposed to and spaced from the photoreceptor drum 101. Note that for clarity of illustration, FIG. 9A depicts the photoreceptor drum 101 only in part. Moreover, an unillustrated developing motor drives the developing roller 141 to rotate in the direction of arrow CW about a center line of rotation CL in FIG. 9A. Here, the width direction of the recording medium S is a direction perpendicular to a direction in which the recording medium S is fed (see FIG. 8). The developing roller 141 is formed so as to have its length direction along the center line of rotation CL so that the developing roller 141 can deal with recording media S of various width sizes.

Here, the housing 140 has provided therein feeding members 1441 and 1442, which are, for example, a pair of screw conveyors. The feeding members 1441 and 1442 are disposed parallel to the center line of rotation CL. The feeding members 1441 and 1442 receive drive force from the developing motor via a transmission mechanism. The drive force drives the feeding members 1441 and 1442 to rotate in the housing 140. As a result, the developer D is stirred in the housing 140. The stirring causes friction between toner particles, thereby charging the toner.

Furthermore, the rotational driving of the feeding members 1441 and 1442 feeds the developer D through the housing 140 along the longitudinal direction of the developing roller 141 (the direction of the center line of rotation CL). Specifically, the feeding member 1441 feeds the developer D inwardly from the front of the sheet of FIG. 9A. Thereafter, the developer D moves to the other feeding member 1442 through an opening (not shown) provided in a partition 1400 between the feeding members 1441 and 1442, the opening being located on the other side viewed from the front of the sheet of FIG. 9A. The feeding member 1442 feeds the developer D outwardly from the inside, and moves to the feeding member 1441 through another opening provided in the partition 1400, the opening being located on the front side of the sheet of FIG. 9A. In this manner, the developer D is circulated within the housing 140 while being stirred.

Furthermore, the housing 140 has a supply space created in opposition to the developing roller 141, for the purpose of supplying the developer D. The circulation provides approximately uniform distribution of the developer D across the supply space in the housing 140, and the developer D is supplied from the supply space to the outer circumferential surface of the developing roller 141. Note that an additional supply of developer D is provided, for example, from behind the feeding member 1442 when viewed from the front of the sheet of FIG. 9A.

The magnet assembly 142 is provided inside the developing roller 141 and is formed in the shape of a roll, for example, with five magnet pieces arranged in the circumferential direction. The magnet assembly 142 includes magnetic poles, which are a catch pole S1, a feeding pole N1, a regulating pole S2, a developing pole N2, and a separating pole S3. Note that "S" and "N" included in the reference characters denote S and N poles.

The catch pole S1 is disposed so as to be approximately opposed to the supply space in the housing 140 and attract the developer D in the housing 140 from the supply space, so that the developer D is supported on the outer circumferential surface of the developing roller 141.

The feeding pole N1 is disposed so as to be opposed to a guide channel 146 to be described later, as shown in enlargement at the left in FIG. 9A. The feeding pole N1 is a magnetic pole for feeding the developer D passing through the guide channel 146, toward the regulating member 143.

The regulating pole S2 and the developing pole N2 are disposed in positions opposed to the regulating member 143 and the developing area Da. The separating pole S3 is disposed between the developing pole N2 and the catch pole S1, creating a repelling magnetic field therebetween, thereby creating a low magnetic area LM with a magnetic flux density of, for example, 5 mT or less along the radial direction of the developing roller 141. Note that the magnetic flux density is essentially defined in vector quantity, but the magnetic flux density herein represents the magnitude of a magnetic flux component in the radial direction of the developing roller 141 (the direction being normal to the surface of the developing roller 141).

Here, the peak magnetic flux densities of the magnetic poles are as follows.

Catch pole S1: 40 mT
Feeding pole N1: 35 mT
Regulating pole S2: 37 mT
Developing pole N2: 100 mT
Separating pole S3: 60 mT The regulating member 143 is made of a magnetic material, and is disposed upstream of the developing area Da in the rotational direction CW of the developing roller 141. Moreover, the regulating member 143 is opposed to the developing roller 141 separated therefrom by gap g11. In addition, the regulating member 143 preferably has a protrusion 1431 formed on its upstream end surface against the rotational direction CW, as shown in enlargement at the left in FIG. 9A. The protrusion 1431 has a length P in the opposite direction to the rotational direction CW.

The developing device 104 further includes a guide member 145 disposed upstream of the regulating member 143 in the rotational direction CW of the developing roller 141. The guide member 145 is made of a non-magnetic material. The guide member 145 is a plate-like member having an arc-like cross section along the rotational direction CW and a thickness of approximately 3 mm.

Such a guide member 145 is disposed between the developing roller 141 and an inner surface 1401 of the housing 140, so as to be opposed to the feeding pole N1 and separated from the developing roller 141 by gap g12. Gap g12 is used as a guide channel 146 to lead the developer D1 into gap g11. Note that the surface of the guide member 145 that is opposed to the developing roller 141 desirably has satisfactory smoothness provided by, for example, fluororesine coating or suchlike.

Furthermore, the guide member 145 is separated from the inner surface 1401 by gap g16. Gap g16 is used as a reflux channel 147 for causing the developer D that has passed through the guide channel 146 to return toward an upstream end 1451 of the guide member 145.

Furthermore, the guide member 145 has a downstream end in the rotational direction CW, which is separated from the protrusion 1431 of the regulating member 143 by gap g15, forming a communication channel 148 where the guide channel 146 communicates with the reflux channel 147.

Here, gap g11 is, for example, 0.5 mm, gap g12 is, for example, 1.5 mm, gap g16 is, for example, 2.0 mm, distance P is, for example, 3.0 mm, and gap g15 is, for example, 1.5 mm.

Here, the upstream end 1451 of the guide member 145 is positioned downstream in the rotational direction CW from the position where the magnetic flux density of the catch pole S1 peaks, as shown in FIG. 9A, for example. Note that in FIG. 9A, the distribution of magnetic flux densities is schematically indicated by a dotted line. The same also applies to FIGS. 9B and 9C.

Figure 9B:
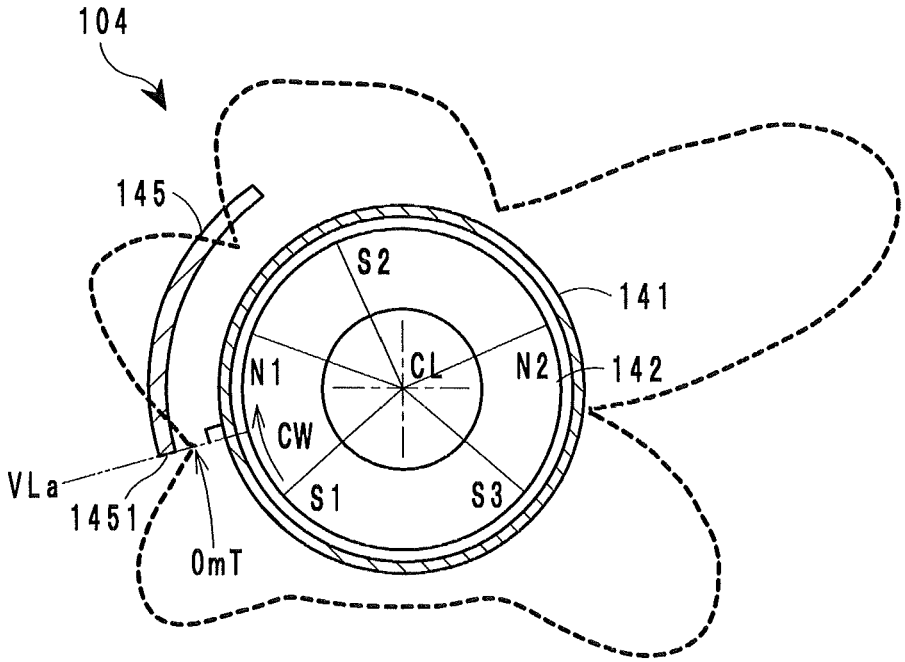
FIG. 9B is a vertical cross section illustrating an exemplary position of an upstream end in FIG. 9A.
Figure 9C:
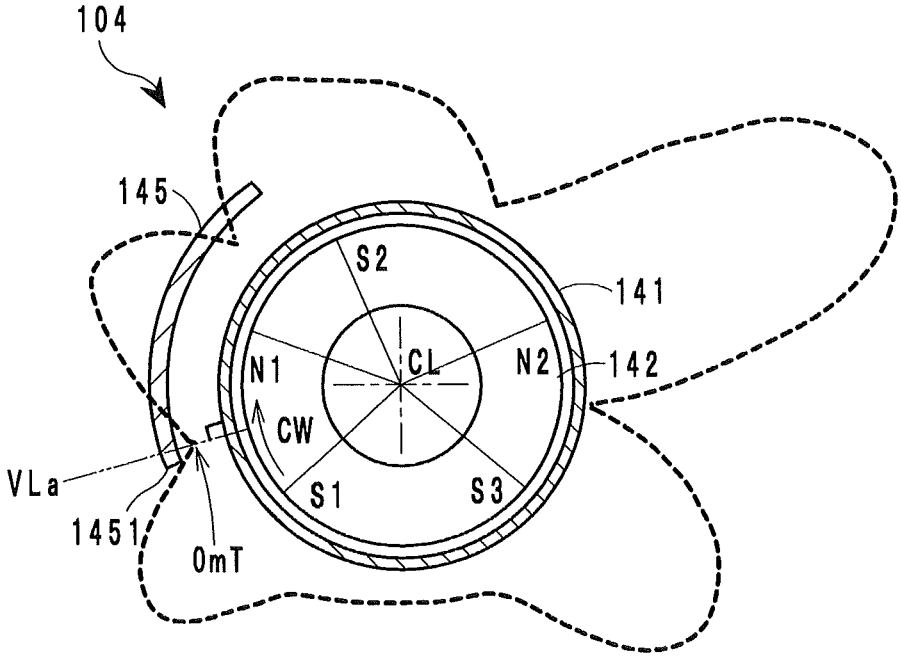
FIG. 9C is a vertical cross section illustrating another exemplary position of the upstream end in FIG. 9A.

Furthermore, the upstream end 1451 is positioned on a virtual line VLa extending in the normal direction to the developing roller 141 so as to pass through a point at which the magnetic flux density is approximately 0 mT between the catch pole S1 and the feeding pole N1, as shown in FIG. 9B. Alternatively, the upstream end 1451 may be positioned upstream of the virtual line VLa in the rotational direction CW, as shown in FIG. 9C.

Figure 10:
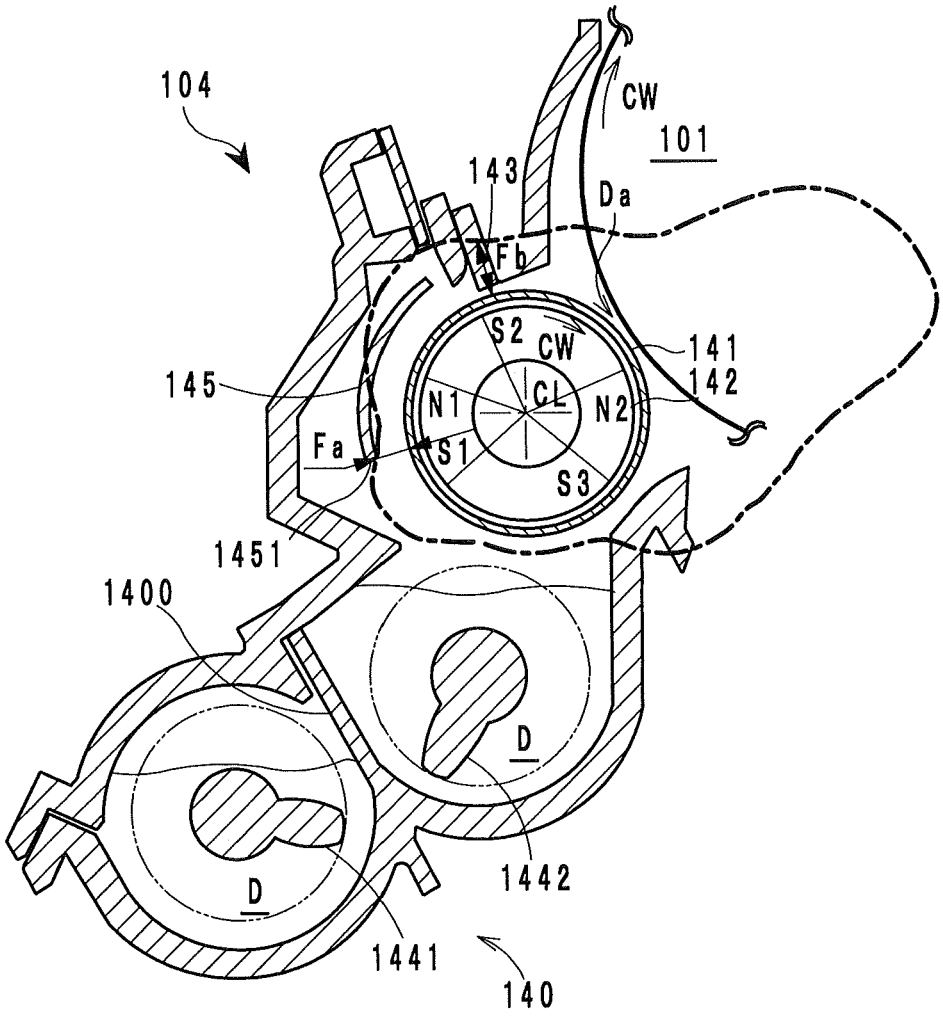
FIG. 10 is a vertical cross section illustrating magnetic attractive force at essential parts of the developing device of FIG. 9A.

Here, as shown in FIG. 10, magnetic attractive force Fa is provided at the position of the upstream end 1451 as a magnetic attractive force in the normal direction to the developing roller 141, and magnetic attractive force Fb is provided at the position of gap g11 created by the regulating member 143, as a magnetic attractive force in the normal direction to the developing roller 141. Note that in FIG. 10, the distribution of magnetic attractive forces is schematically indicated by a long dashed short dashed line. In the present embodiment, the position of the upstream end 1451 and the magnet assembly 142 are designed such that magnetic attractive force Fa is lower than magnetic attractive force Fb. For example, magnetic attractive force Fa is 1.40 g at a distance of 0.1 mm from the surface of the developing roller 141, and magnetic attractive force Fb is 2.01 g at the same distance. Note that magnetic attractive forces Fa and Fb can be measured using a scale load cell.

Developer Feeding in Developing Device

Next, the path to feed the developer D will be briefly described. In FIG. 9A, the developer D attracted onto the surface of the developing roller 141 through magnetic force applied by the catch pole S1 of the magnet assembly 142 is fed from the catch pole S1 toward gap g11 created by the regulating member 143, under action of frictional force through rotation of the developing roller 141. The developer D supported on the surface of the developing roller 141 initially reaches the upstream end 1451 of the guide member 145. The amount of the developer D that is fed is limited by the upstream end 1451 so as not to be excessive.

Furthermore, the guide member 145 creates the guide channel 146 and the reflux channel 147 as passages for the developer D, both of which are immediately upstream of the regulating member 143. The developer D that has passed the upstream end 1451 is fed through the guide channel 146 in the same direction as the rotational direction CW of the developing roller 141. The developer D that has exited the guide channel 146 passes through gap g11 created by the regulating member 143 to be supplied downstream to the developing area Da.

On the other hand, the developer D regulated by the regulating member 143 flows from the guide channel 146 into the reflux channel 147 via the communication channel 148. Thereafter, the developer D moves toward the upstream end 1451 of the guide member 145 in accordance with gravity.

Actions and Effects of Developing Device of Present Embodiment

In short, the developing device 104 is characterized in that: (1) the upstream end 1451 is positioned downstream of the position where the magnetic flux density of the catch pole S1 peaks (see FIG. 9A); (2) the upstream end 1451 is positioned in alignment with the position of 0 mT magnetic flux density between the catch pole S1 and the feeding pole N1 (see FIG. 9B) or it is positioned upstream of that position of 0 mT magnetic flux density (see FIG. 9C); and (3) magnetic attractive force Fa at the upstream end 1451 is lower than magnetic attractive force Fb in gap g11 created by the regulating member 143 (see FIG. 10). Thus, it is possible to prevent a binary developer from being excessively fed and further inhibit stress on the binary developer. To clarify such technical advantages, the present inventors compared the developing device 104 with developing devices in Comparative Examples 1 to 3 shown in FIGS. 11 to 13.

Figure 11:
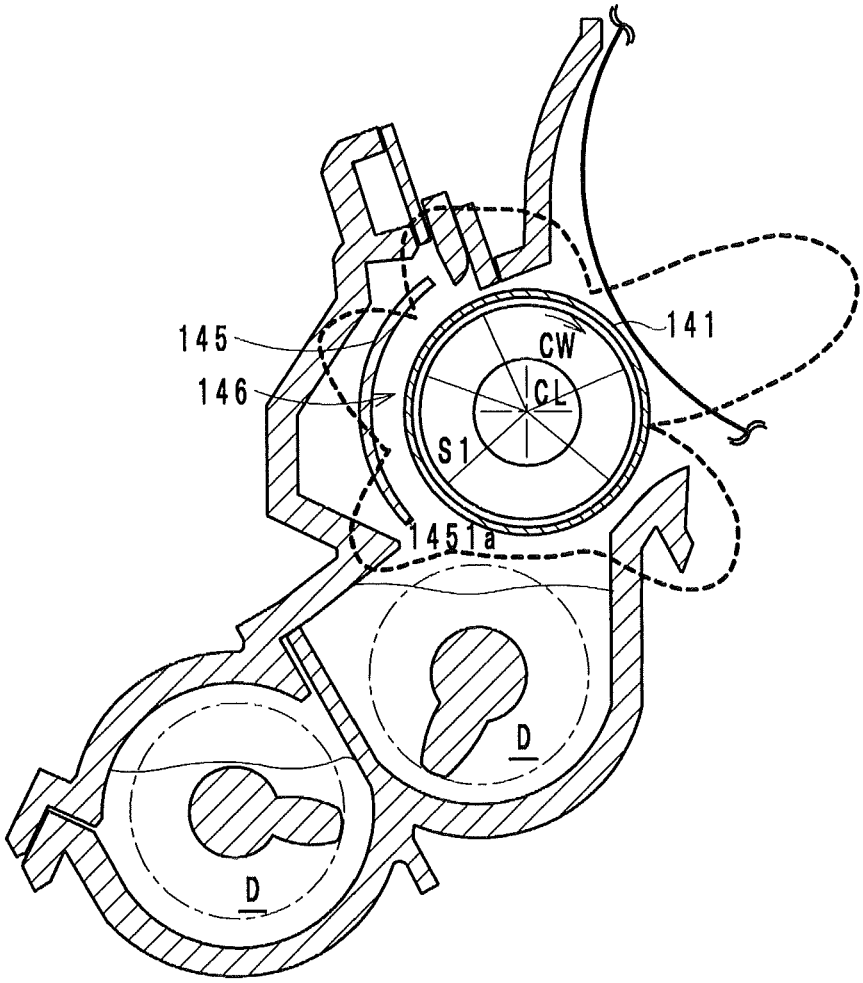
FIG. 11 is a vertical cross section schematically illustrating the configuration of a developing device according to Comparative Example 1.

First, Comparative Example 1 simply differs from the developing device 104 in that the upstream end 1451*a* of the guide member 145 is not positioned downstream of the position where the magnetic flux density of the catch pole S1 peaks, as shown in FIG. 11.

Figure 12:
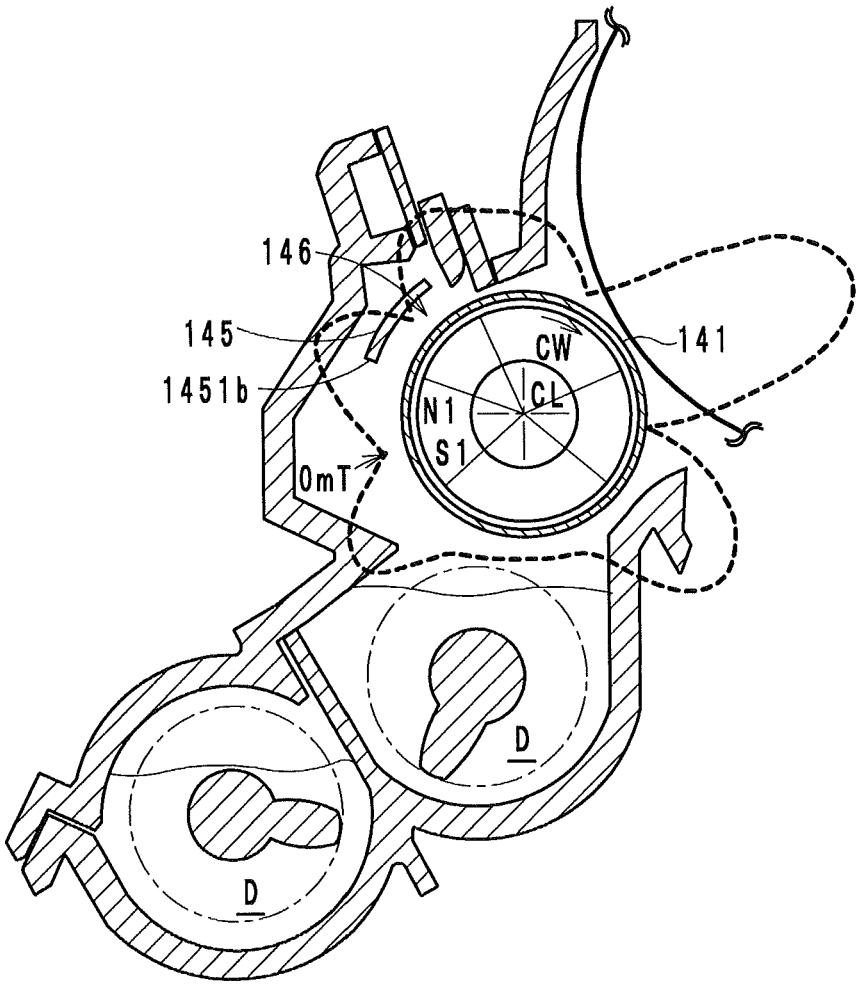
FIG. 12 is a vertical cross section schematically illustrating the configuration of a developing device according to Comparative Example 2.

Furthermore, Comparative Example 2 simply differs from the developing device 104 in that the upstream end 1451*b* of the guide member 145 is positioned downstream of the 0 mT position between the catch pole S1 and the feeding pole N1, as shown in FIG. 12.

Figure 13:
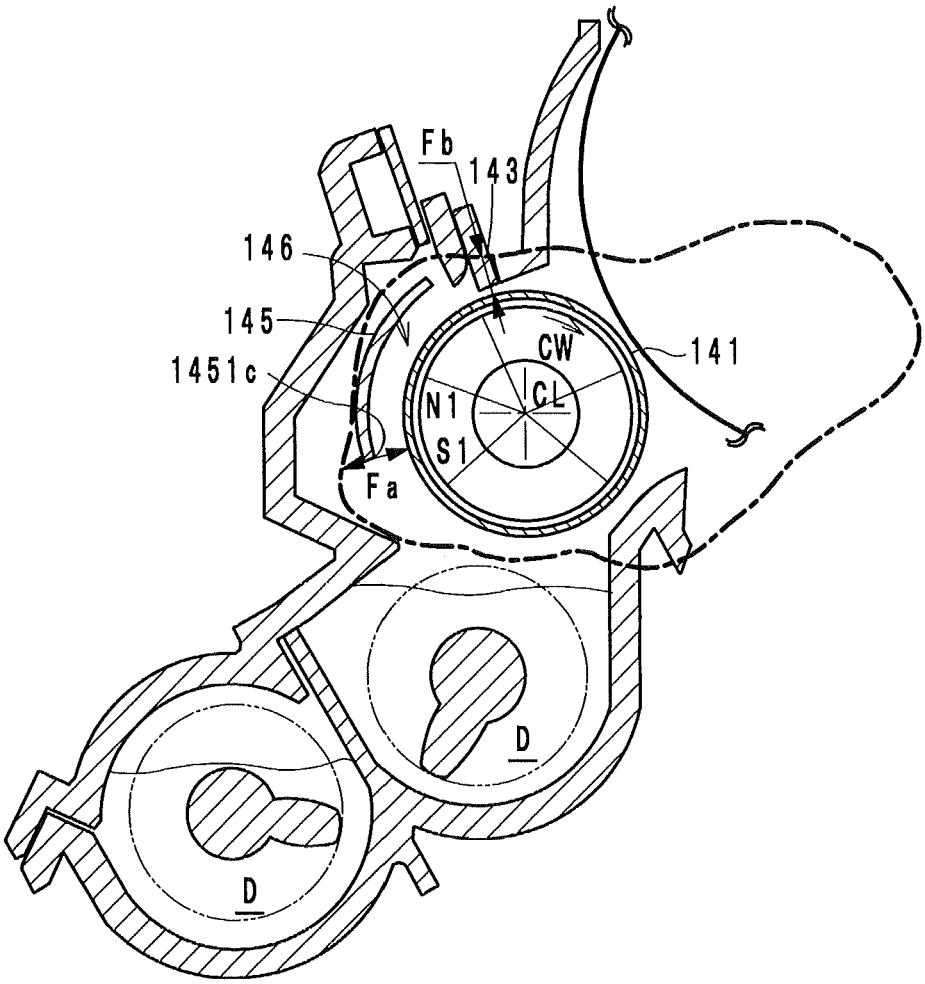
FIG. 13 is a vertical cross section schematically illustrating the configuration of a developing device according to Comparative Example 3.
Figure 14:
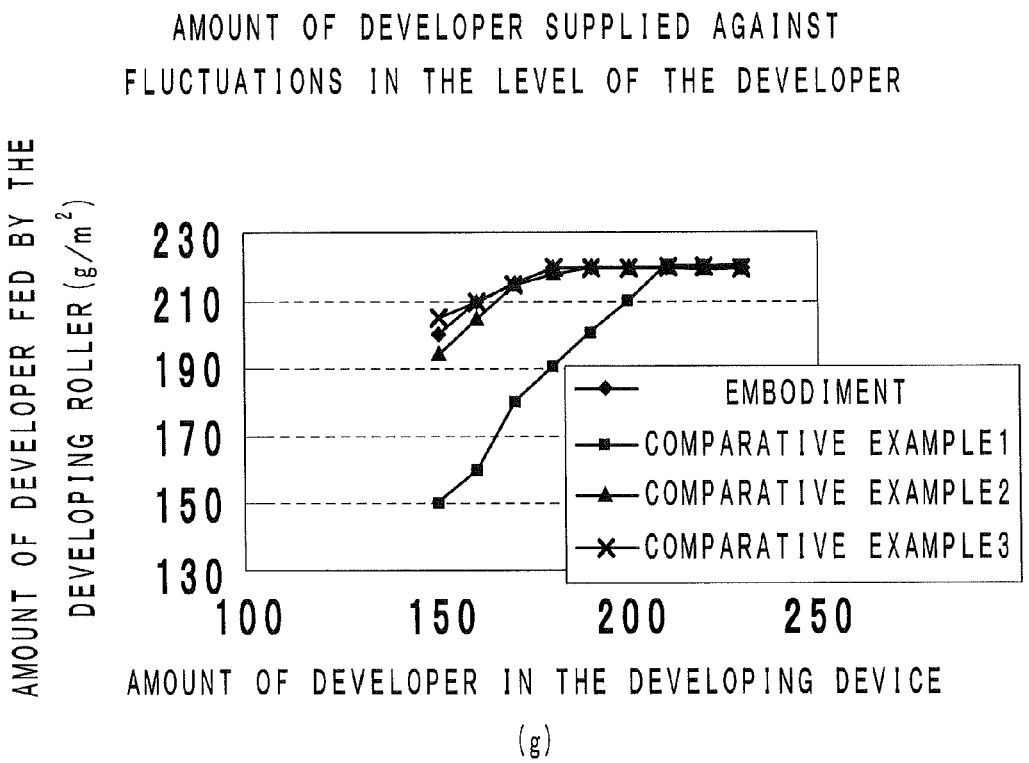
FIG. 14 is a graph showing stability in the amount of developer supplied to the developing roller against fluctuations in the level of the developer for the embodiment and Comparative Examples 1 through 3.
Figure 15:
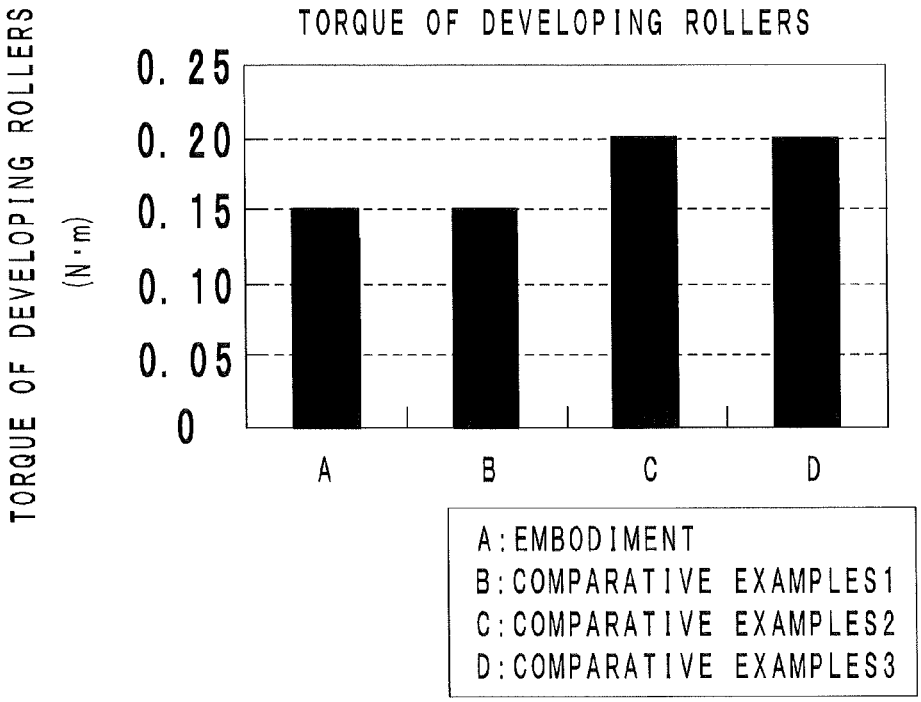
FIG. 15 is a graph showing rotation torques of developing rollers in the embodiment and Comparative Examples 1 through 3.

Furthermore, Comparative Example 3 simply differs from the developing device 104 in that magnetic attractive force Fa at the upstream end 1451*c* of the guide member 145 is not lower than magnetic attractive force Fb in gap g11 created by the regulating member 143, as shown in FIG. 13.

In Comparative Example 1 of FIG. 11, the upstream end 1451*a* of the guide member 145 is positioned upstream of the position where the magnetic flux density of the catch pole S1 peaks. Accordingly, disposition of the catch pole S1 limits the amount of the developer D that is supplied to the guide channel 146 of the guide member 145. This results in reduced stability in the amount of the developer D that is supplied to the developing roller 141 against fluctuations in the level of the developer D through stirring by the feeding members 1441 and 1442, although the developer D can be prevented from being excessively fed, as can be appreciated with reference to the curve plotted with solid squares in FIG. 14.

Furthermore, in Comparative Example 2 of FIG. 12, as in the developing device 104, the upstream end 1451*b* of the guide member 145 is positioned downstream of the position where the magnetic flux density of the catch pole S1 peaks. Therefore, in Comparative Example 2, the stability in the amount of the developer D that is supplied to the developing roller 141 is approximately the same as in the developing device 104, as can be appreciated with reference to the curve plotted with solid triangles in FIG. 14. However, in Comparative Example 2, the upstream end of the guide member 145 is positioned downstream of the 0 mT position between the catch pole S1 and the feeding pole N1. Therefore, the distance from the catch pole S1 to the upstream end of the guide member 145 is longer, resulting in a larger amount of excess developer D being fed. Accordingly, when compared with the developing device 104, the developing roller 141 of Comparative Example 2 has a higher rotation torque, as can be appreciated with reference to FIG. 15.

Figure 16:
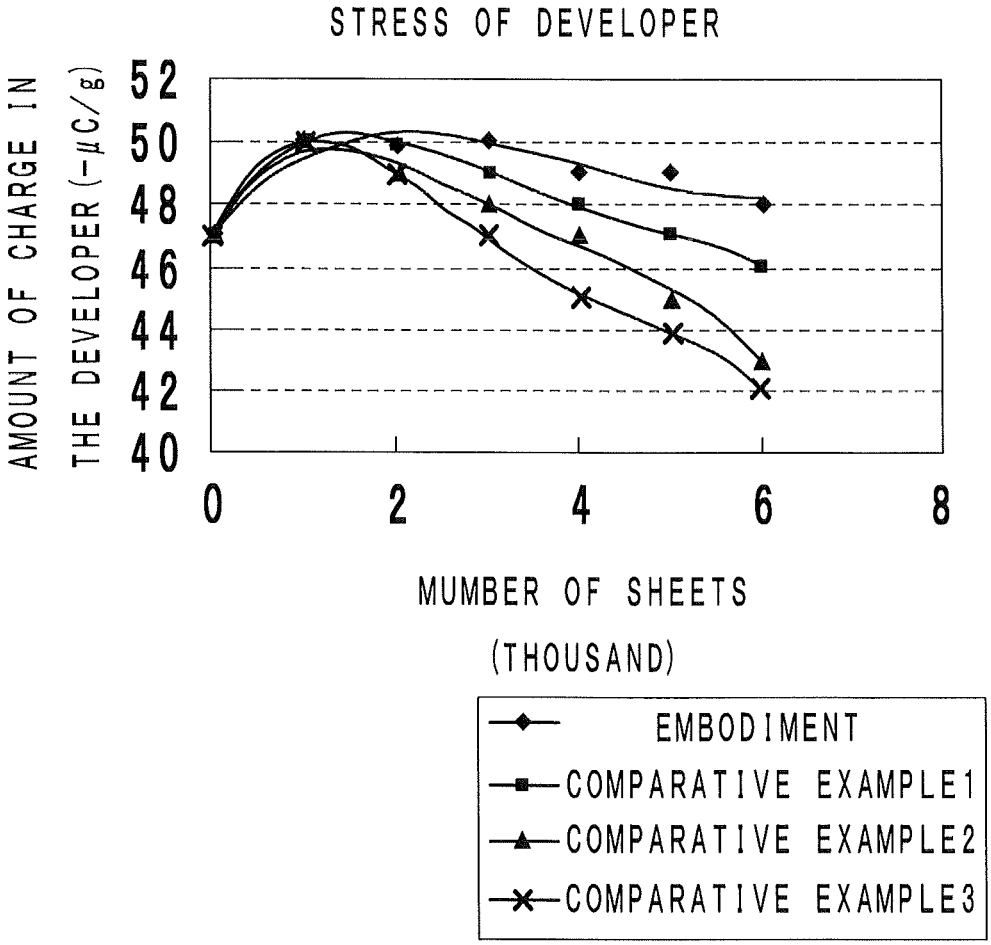
FIG. 16 is a graph showing deterioration of the developer for the embodiment and Comparative Examples 1 through 3.

Furthermore, in Comparative Example 3 of FIG. 13, as in the developing device 104, the upstream end 1451*c* of the guide member 145 is positioned downstream of the position where the magnetic flux density of the catch pole S1 peaks. Therefore, in Comparative Example 3, the stability in the amount of the developer that is supplied to the developing roller 141 is approximately the same as in the developing device 104, as can be appreciated with reference to the curve plotted with crosses in FIG. 14. However, in Comparative Example 3, magnetic attractive force Fa at the upstream end is higher than magnetic attractive force Fb in gap g11 created by the regulating member 143. Therefore, when the amount of developer to be fed is regulated, the developer is dragged away from the developing roller 141 in defiance of a relatively high magnetic attractive force at the upstream end 1451*c* of the guide member 145. Here, FIG. 16 is a graph of the amount of charge in the developer over the number of sheets of recording medium S with images formed thereon, as measured for each of the present embodiment and Comparative Examples 1 to 3. For Comparative Example 3, the larger the number of sheets, the less the amount of charge in the developer, as can be appreciated with reference to FIG. 16. In this manner, Comparative Example 3 tends to have higher stress on the developer, resulting in expedited deterioration of the developer.

On the other hand, the developing device 104 has characteristics (1) through (3) above, so that the distance of feeding an excess developer can be minimized, and therefore an increase in the rotation torque of the developing roller 141 can be inhibited. Moreover, because of characteristic (3), the developing device 104 can eliminate the need for excessively high energy to drag the developer away from the developing roller 141 at the upstream end 1451 of the guide member 145. As a result, the developing device 104 does not apply high stress to the developer, so that the developer can be inhibited from deteriorating.

Note that in the above embodiment, the image forming apparatus 110 has been described as forming a monochrome image. However, this is not restrictive, and the developing device 104 may be employed in an image forming apparatus for color image formation. Moreover, in such a case, for example, the image forming apparatus includes developing devices for four colors yellow, magenta, cyan, and black, and at least one of the developing devices is the developing device described in the present embodiment.

Furthermore, since the image forming apparatus 110 includes the developing device 104, stress on the developer can be minimized, and further, deterioration of the developer can be reduced. Thus, occurrence of an image defect or suchlike can be inhibited, making it possible to provide an image forming apparatus 110 capable of forming a satisfactory image.

Furthermore, the above embodiment has been described with respect to the case where one feeding pole N1 is provided, but this is not restrictive, and a plurality of feeding poles N1 may be provided so as to be opposed to the guide channel 146. In such a case, the upstream end 1451 of the guide member 145 is provided upstream in the rotational direction CW with respect to the position where the magnetic flux density of one of the feeding poles N1 that is adjacently downstream of the regulating pole S2 in the rotational direction is substantially 0, or the upstream end 1451 is provided at the position where the magnetic flux density of that feeding pole is substantially 0.

Note that in the case where more than one feeding pole are provided, all feeding poles do not have to be equal in polarity, and may include both N and S poles.

Embodiment C

General Configuration of Image Forming Apparatus

Figure 17:
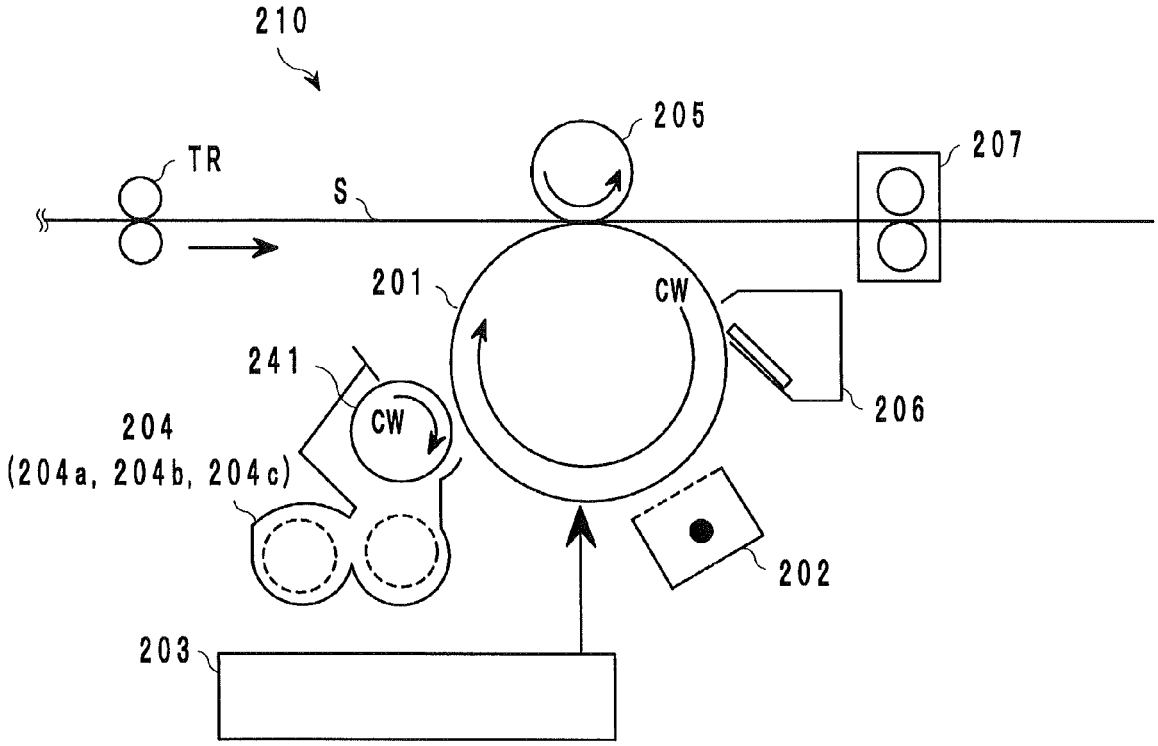
FIG. 17 is a schematic diagram illustrating an image forming apparatus to which developing devices according to embodiments of the present invention can be applied.

Described first is an image forming apparatus to which a developing device according to Embodiment C of the present invention can be applied. In FIG. 17, an image forming apparatus 210 is a printer for forming a monochrome image on a recording medium S such as recording paper, for example.

The image forming apparatus 210 includes a photoreceptor drum 201, which is a typical example of an electrostatic image support. The image forming apparatus 210 has a charger 202, an image exposing device 203, a developing device 204, a transfer roller 205, and a cleaning device 206 arranged around the photoreceptor drum 201 in the same order. In addition, the image forming apparatus 210 includes a unit for supplying the recording medium S, and also includes a fusing device 207 and an output tray provided downstream of the transfer roller 205 in a direction in which the supply unit feeds the recording medium S. Note that the supply unit and the output tray are not shown for convenience.

The photoreceptor drum 201 is, for example, a negatively chargeable photoreceptor whose surface can be uniformly charged to a predetermined negative potential by the charger 202.

The image exposing device 203 receives image information transmitted by an unillustrated image reading apparatus, computer, external facsimile, or suchlike. The image exposing device 203 exposes to light the surface of the photoreceptor drum 201 being charged by the charger 202, on the basis of the received image information, thereby forming an electrostatic latent image on that surface.

The developing device 204 uses a binary developer (simply referred to below as a "developer") including toner and magnetic carrier, to develop the electrostatic latent image on the photoreceptor drum 201. The toner is, for example, a negatively chargeable toner made by polymerization and having an average particle size of 6 μm. Moreover, the magnetic carrier has an average particle size of 33 μm. The developing device 204 forms a toner image by developing the electrostatic latent image through reversal development using the negatively charged toner. Note that the configuration of the developing device 204 will be described in detail later.

The image forming apparatus 210 thus configured forms a toner image on a recording medium S in the following manner. First, an unillustrated photoreceptor drive motor drives the photoreceptor drum 1 to rotate clockwise as indicated by arrow CW in FIG. 17 (referred to below as the "rotational direction CW"). The surface of the photoreceptor drum 201 is uniformly charged to a predetermined potential by the charger 202 to which charging bias is being applied. The image exposing device 203 exposes the charged area to light, thereby forming an electrostatic latent image on the surface of the photoreceptor drum 201 on the basis of input image information. The developing device 204 develops the electrostatic latent image, thereby forming a toner image on the photoreceptor drum 201.

Furthermore, the recording medium S is supplied from the supply unit to a timing roller TR in FIG. 17. The timing roller TR adjusts the timing of the recording medium S being introduced to and passing through a transfer nip between the photoreceptor drum 201 and the transfer roller 205. At this time, the transfer roller 205 has applied thereto a transfer voltage from a transfer power source (not shown), so that the toner image on the photoreceptor drum 201 is transferred onto the recording medium S. The recording medium S having the toner image transferred thereon passes through the fusing device 207. The fusing device 207 heats and presses the recording medium S, thereby fixing the toner image on the recording medium S, which is ejected onto the output tray thereafter. After the toner image is transferred, the cleaning device 206 cleans the surface of the photoreceptor drum 201 for subsequent image formation.

First Embodiment

Figure 18:
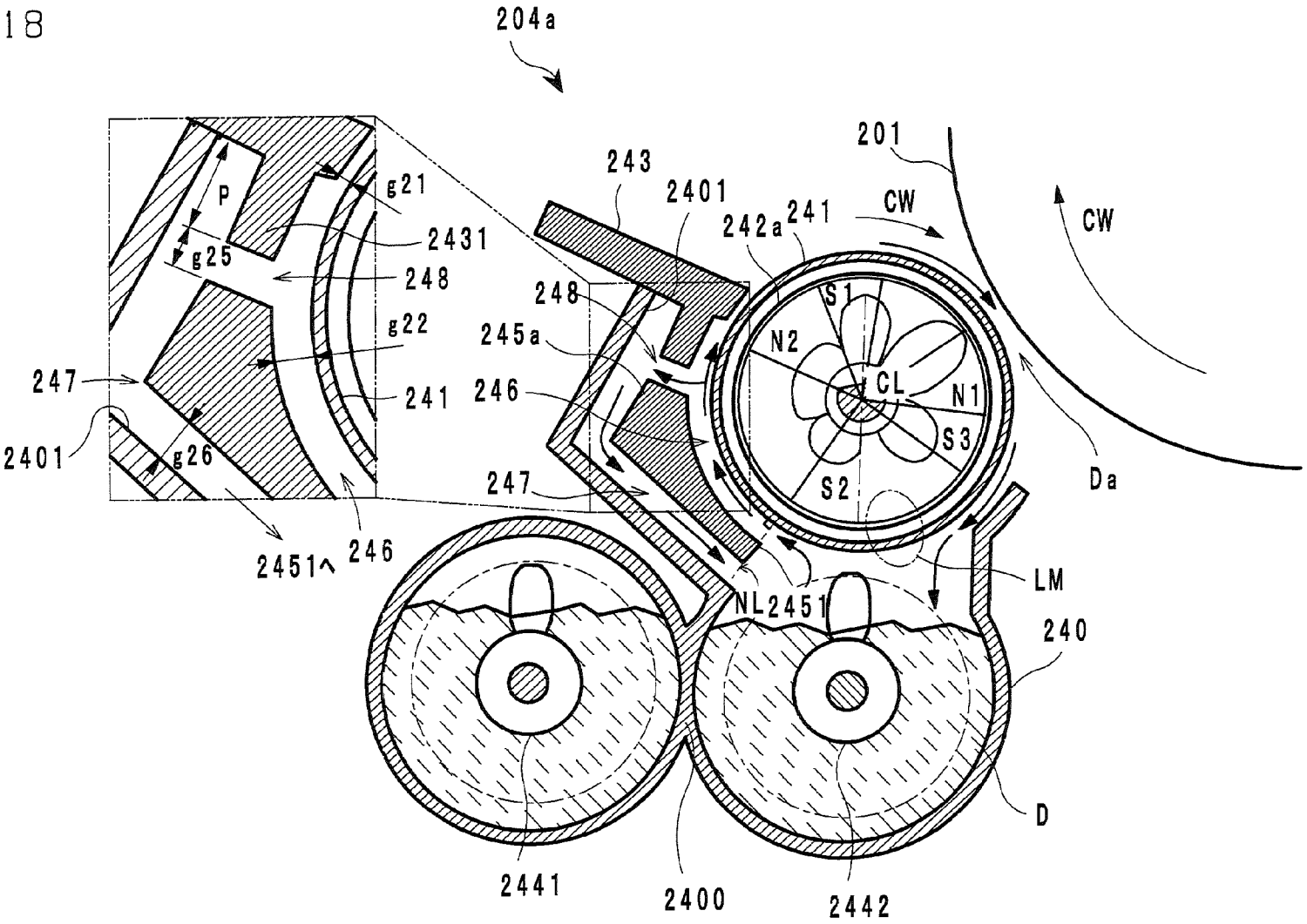
FIG. 18 is a vertical cross section schematically illustrating the configuration of a developing device according to a first embodiment.
Figure 19:
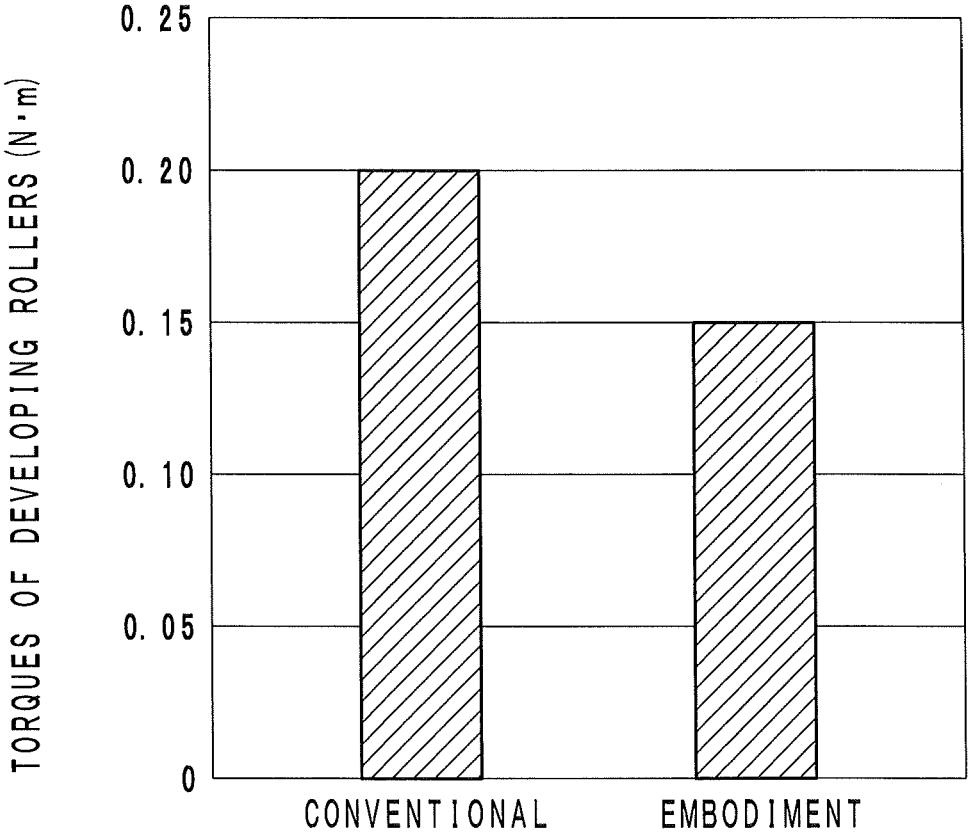
FIG. 19 is a graph showing measurement results for rotation torques of developing rollers in the developing device of FIG. 18 and a conventional developing device.
Figure 20:
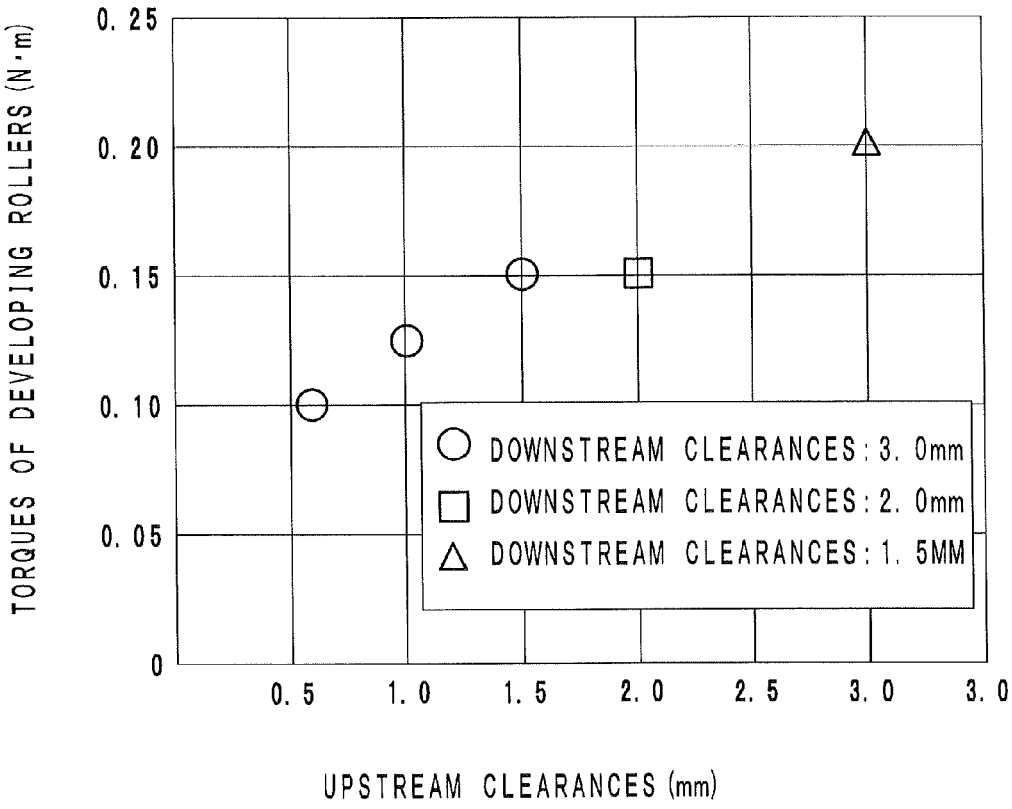
FIG. 20 is a graph showing effects of upstream and downstream clearances of a guide member on the rotation torque of the developing roller.

Next, referring to FIGS. 18 to 20, the developing device 204*a* of FIG. 17 will be described in detail. In FIG. 18, the developing device 204*a* includes a housing 240, a developing roller 241, a magnet assembly 242*a*, and a regulating member 243.

The developing roller 241 is a typical example of a developer support. The developing roller 241 is a cylindrical sleeve made of a non-magnetic material and having an outer diameter of, for example, 16 mm. The outer circumferential surface of the developing roller 241 is roughened, for example, by blasting to a proper degree to feed the developer D.

Furthermore, the developing roller 241 is disposed in an opening provided in the housing 240 toward the photoreceptor drum 201, so as to be opposed to and spaced from the photoreceptor drum 201. Note that for clarity of illustration, FIG. 18 depicts the photoreceptor drum 1 only in part. Moreover, an unillustrated developing motor drives the developing roller 241 to rotate in the direction of arrow CW about a center line of rotation CL in FIG. 18. The direction of arrow CW will be referred to below as the "rotational direction CW". Moreover, the rotational direction CW is the direction in which the developer D is fed. Here, the width direction of the recording medium S is a direction perpendicular to a direction in which the recording medium S is fed (see FIG. 17). The developing roller 241 is formed so as to have its length direction along the center line of rotation CL so that the developing roller 241 can deal with recording media S of various width sizes.

Here, the housing 240 has provided therein feeding members 2441 and 2442, which are, for example, a pair of screw conveyors. The feeding members 2441 and 2442 are disposed parallel to the center line of rotation CL. The feeding members 2441 and 2442 receive drive force from the developing motor via a transmission mechanism. The drive force drives the feeding members 2441 and 2442 to rotate in the housing 240. As a result, the developer D is stirred in the housing 240. The stirring causes friction between toner particles, thereby charging the toner.

Furthermore, the rotational driving of the feeding members 2441 and 2442 feeds the developer D through the housing 240 along the longitudinal direction of the developing roller 241 (the direction of the center line of rotation CL). Specifically, the feeding member 2441 feeds the developer D inwardly from the front of the sheet of FIG. 18. Thereafter, the developer D moves to the other feeding member 2442 through an opening (not shown) provided in a partition 2400 between the feeding members 2441 and 2442, the opening being located on the other side viewed from the front of the sheet of FIG. 18. The feeding member 2442 feeds the developer D outwardly from the inside, and moves to the feeding member 2441 through another opening provided in the partition 2400, the opening being located on the front side of the sheet of FIG. 18. In this manner, the developer D is circulated within the housing 240 while being stirred.

Furthermore, the housing 240 has a supply space created in opposition to the developing roller 241, for the purpose of supplying the developer D. The circulation provides approximately uniform distribution of the developer D across the supply space in the housing 240, and the developer D is supplied from the supply space to the outer circumferential surface of the developing roller 241. Note that an additional supply of developer D is provided, for example, from behind the feeding member 2442 when viewed from the front of the sheet of FIG. 18.

The magnet assembly 242*a* is provided inside the developing roller 241 and is formed in the shape of a roll, for example, with five magnet pieces arranged in the circumferential direction. The magnet assembly 242*a* includes magnetic poles, which are a catch pole S2, a regulating pole N2, a feeding pole S1, a developing pole N1, and a separating pole S3. Note that "S" and "N" included in the reference characters refer to S and N poles, respectively.

The catch pole S2 is provided so as to be opposed to the supply space in the housing 240 and attract the developer D in the housing 240 from the supply space, so that the developer D is supported on the surface of the developing roller 241.

The regulating pole N2 is disposed in a position opposed to the regulating member 243 (to be described later), so as to be adjacently downstream of the catch pole S2 in the rotational direction CW.

The feeding pole S1 is disposed so as to be adjacently downstream of the regulating pole N2 in the rotational direction CW. Moreover, the feeding pole S1 is a magnetic pole for feeding the developer D that has passed through gap g1 (to be described later) created by the regulating member 243, toward a developing area Da for developing an electrostatic latent image on the photoreceptor drum 201.

The developing pole N1 is disposed in a position opposed to the developing area Da.

The separating pole S3 is disposed between the developing pole N1 and the catch pole S2, and creates a repelling magnetic field therebetween, thereby creating low magnetic area LM with a magnetic flux density of, for example, 5 mT or less (see a portion enclosed by long dashed double-short dashed lines in the figure). In the low magnetic area LM, the developer D that remains supported by the developing roller 241 without being transferred to the surface of the photoreceptor drum 201 falls into the housing 240.

Note that the arrangement of the magnetic poles in the magnet assembly 242*a* is not limited to the above, and the magnetic poles may be arranged in different patterns.

The regulating member 243 is made of a magnetic material, and is disposed upstream of the developing area Da in the rotational direction CW. Moreover, the regulating member 243 is opposed to and separated from the developing roller 241 by gap g21. In addition, the regulating member 243 preferably has a protrusion 2431 formed on its upstream end surface, the protrusion 2431 having a length P in the opposite direction to the rotational direction CW, as shown in enlargement at the left in FIG. 18.

The developing device 204*a* further includes a guide member 245*a* disposed upstream of the regulating member 243 in the rotational direction CW. The guide member 245*a* is made of a non-magnetic material and positioned between the developing roller 241 and an inner surface 2401 of the housing 240.

More specifically, the guide member 245*a* is separated from the developing roller 241 by gap g22. Provided between the guide member 245*a* and the developing roller 241 is a guide channel 246 for leading the developer D1 into gap g21. Note that the surface of the guide member 245*a* that faces the developing roller 241 desirably has satisfactory smoothness provided by, for example, fluororesine coating or suchlike.

Furthermore, the guide member 245*a* is separated from the inner surface 2401 by gap g26. Provided between the guide member 245*a* and the inner surface 2401 is a reflux channel 247 for causing the developer D to return toward an upstream end 2451 of the guide member 245*a* against the rotational direction CW.

Furthermore, there is provided a communication channel 248 with a size of gap g25 at a downstream end of the guide member 245*a* in the rotational direction CW, specifically, the end being proximal to the regulating member 243 (in this example, a position at distance P upstream from the regulating member 243), and the communication channel 248 allows the guide channel 246 to communicate with the reflux channel 247.

Here, the normal line to the outer circumferential surface of the developing roller 241, which passes through the position where the magnetic flux density of the closest downstream magnetic pole to the low magnetic area LM (in the present embodiment, the catch pole S2) peaks, will be denoted by NL. The upstream end 2451 is positioned on the normal line NL. Note that in the present embodiment, the magnetic flux density Br of the catch pole S2 along the radial direction of the developing roller 241 is assumed to be 45 mT on the surface of the developing roller 241.

Here, gap g21 is, for example, 0.5 mm, gap g22 is, for example, 1.5 mm, gap g26 is, for example, 2.0 mm, distance P is, for example, 3.0 mm, and gap g25 is, for example, 1.5 mm.

With the developing device 204*a*, the developer D being attracted onto the surface of the developing roller 241 via magnetic force applied by the catch pole S2 of the magnet assembly 242*a* is fed toward gap g21 created by the regulating member 243, under action of frictional force through rotation of the developing roller 241. The amount of developer D is regulated by gap g21, and thereafter, the developer D that has passed through gap g21 is fed through the developing area Da while being set in a spiked state by the developing pole N1. The spiking developer D is used to develop an electrostatic latent image formed on the photoreceptor drum 201. In addition, the developer D not used for the developing returns to the housing 240 while being held on the developing roller 241, and falls from the developing roller 241 in the low magnetic area LM.

It should be noted here that, with the developing device 204*a*, the amount of the developer D that is supplied to the developing roller 241 is limited so as not to be excessive by the upstream end 2451 of the guide member 245*a*. Moreover, the upstream end 2451 of the guide member 245*a* is positioned so as to correspond to the position where the magnetic flux density of the magnetic pole S2, which is closest to the low magnetic area LM on the downstream side, peaks. Therefore, the force of attracting the developer D onto the developing roller 241 is relatively low near the upstream end 2451, so that stress on the developer D is kept low near the upstream end 2451.

Furthermore, the guide member 245*a* creates the guide channel 246 and the reflux channel 247 as passages for the developer D, both of which are immediately upstream of the regulating member 243. The guide channel 246 is a space created between the developing roller 241 and the guide member 245*a*. In the guide channel 246, the developer D is fed in the same direction as the rotational direction CW of the developing roller 241. In addition, the reflux channel 247 is a space created between the guide member 245*a* and the housing 240. In the reflux channel 247, the developer D moves against the rotational direction CW. Specifically, the developer D that has been hindered by the regulating member 243 from being fed to the developing area Da flows from the guide channel 246 into the reflux channel 247 via the communication channel 248. Thereafter, the developer D moves toward the upstream end 2451 of the guide member 245*a* in accordance with gravity.

Here, since the guide member 245*a* limits the clearance from the surface of the developing roller 241, the developer D being fed through the guide channel 246 is accumulated immediately before the regulating member 243 in a larger amount than in the case where the guide member 245*a* is not provided.

Furthermore, the pressure being applied to the developer D immediately before the regulating member 243 is canceled by the communication channel 248, and the developer D failing to pass through gap g21 is caused to return toward the upstream end 2451 through the reflux channel 247, so that the pressure on the developer D can be prevented from becoming excessively high immediately before the regulating member 243.

In this manner, with the developing device 204*a*, the amount of the developer D that is accumulated immediately before the regulating member 243 can be reduced while minimizing stress on individual particles included in the developer D, so that stress applied to the developer D immediately before the regulating member 243 can be reduced.

Furthermore, since the developing device 204*a* minimizes the accumulation of the developer D immediately before the regulating member 243, the developer D failing to pass the regulating member 243 can be inhibited from being rubbed against the developing roller 241 (i.e., rubbing reaction force can be inhibited from being applied to the developing roller 241), resulting in the advantage of being able to keep the rotation torque of the developing roller 241 low.

In the above embodiment, the upstream end 2451 is positioned so as to be opposed to the position where the magnetic flux density of the catch pole S2 peaks. However, this is not restrictive, and the upstream end 2451 may be positioned upstream of the catch pole S2 and downstream of the low magnetic area LM, so long as the developer D can be attracted onto the surface of the developing roller 241.

Furthermore, in the present embodiment, gap g22 has been described as being set at 1.5 mm. However, gap g22 does not have to be 1.5 mm uniformly across the entire reflux channel 247. For example, to inhibit clogging of the developer D, the gap may be smaller on the upstream side of the reflux channel 247 than on the downstream side.

Furthermore, the present inventors measured the developing roller of the developing device 204*a* and the developing roller of the conventional developing device 208 (see FIG. 24) for their rotation torques. The developing devices 204*a* and 208 were measured under the same conditions in terms of their developing rollers, magnet assemblies, regulating members, etc., and the circumferential speed of each developing roller was set at 302 mm/second.

As the amount of the developer that is accumulated immediately before the regulating member increases, the force of rubbing the developer against the developing roller increases, resulting in an increased rotation torque of the developing roller. However, as shown in FIG. 19, in the conventional developing device 208, the rotation torque of the developing roller is 0.20 N·m, whereas in the developing device 204*a*, the rotation torque of the developing roller is 0.15 N·m. Accordingly, the rotation torque of the developing device 204*a* is reduced by about 20% from that of the conventional developing device 208. It can be appreciated that with the developing device 204*a*, the amount of the developer that is accumulated immediately before the regulating member is kept low, and further, stress on the developer is also kept low, as described above.

Furthermore, the present inventors measured the developing device 204*a* for the rotation torque of the developing roller where the gap (downstream clearance) between the downstream end of the guide member 245*a* and the surface of the developing roller 241 was 1.5 mm, and the gap (upstream clearance) between the upstream end of the guide member 245*a* and the surface of the developing roller 241 was changed among 0.6 mm, 1.0 mm, and 1.5 mm. Likewise, measurements for the rotation torque of the developing roller were carried out where each of the downstream and upstream clearances was 2.0 mm and thereafter 3.0 mm. The measurement results are shown in FIG. 20. It can be appreciated from FIG. 20 that when the clearance between the guide member 245*a* and the developing roller is approximately 2 mm or less, a rotation torque of 0.15 N·m can be achieved, which is lower than conventional. Note that the developing device 204*a* may have the guide member 245*a* integrated with the housing 240 for the purpose of reducing the number of parts.

Second Embodiment

As described above, the developing device 204*a* of the first embodiment can keep stress on the developer low. However, there is another issue, which is of concern about insufficient charge in the developer. Specifically, the developer is normally charged by friction between the magnetic carrier and the toner included in the developer. Accordingly, the less stress on the developer, the less energy for such frictional charging.

Therefore, the developing device 204*b* of the second embodiment aims to provide energy required for frictional charging while keeping stress on the developer low.

Figure 21:
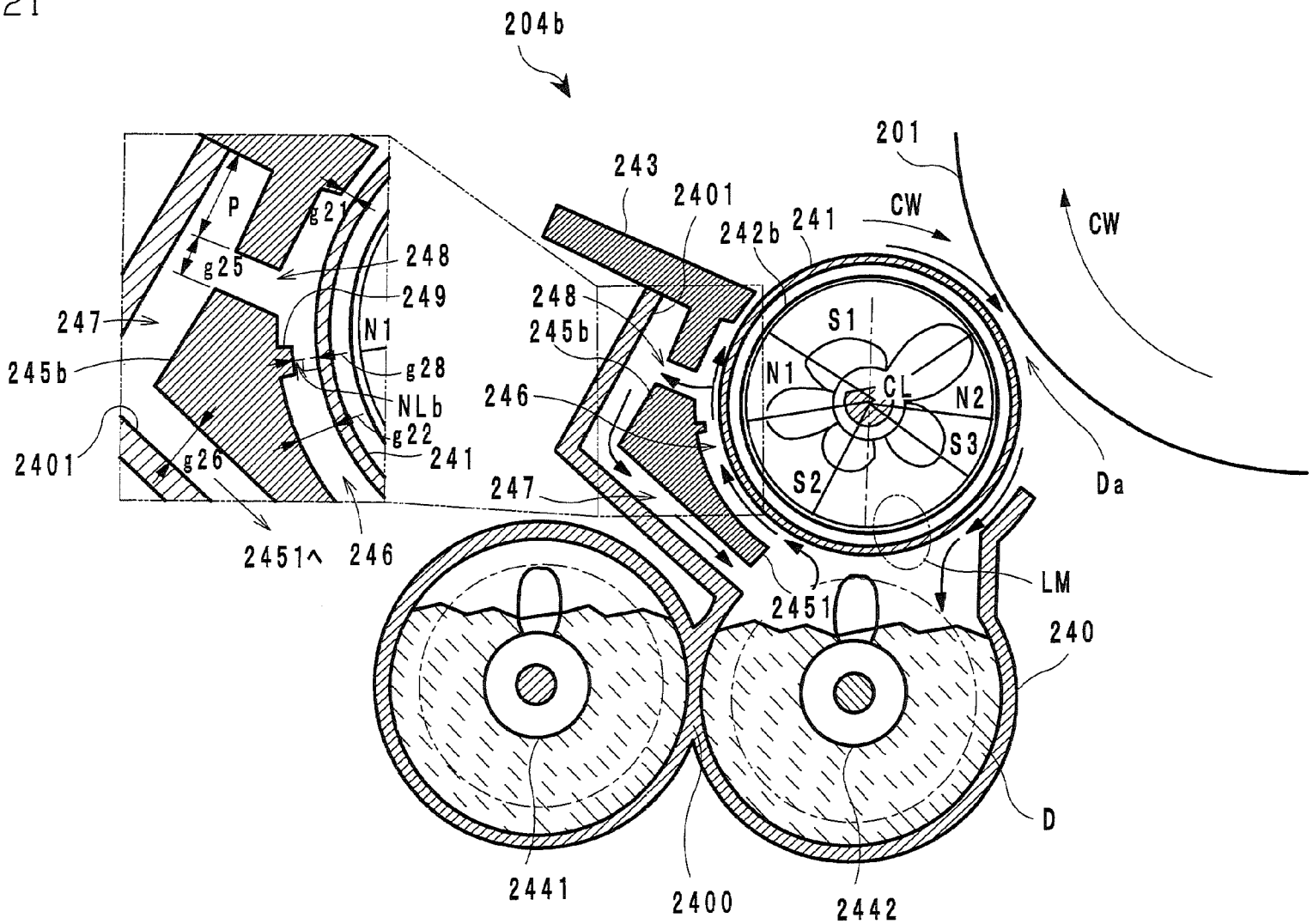
FIG. 21 is a vertical cross section schematically illustrating the configuration of a developing device according to a second embodiment.

FIG. 21 is a vertical cross section schematically illustrating the configuration of the developing device 204*b* of FIG. 17. In FIG. 21, the developing device 204*b* differs from the developing device 204*a* in that a magnet assembly 242*b* is provided in place of the magnet assembly 242*a*. There is no other difference between the developing devices 204*a* and 204*b*. Therefore, in FIG. 21, elements corresponding to those in FIG. 18 are denoted by the same reference characters, and any descriptions thereof will be omitted.

Unlike the magnet assembly 242*a*, the magnet assembly 242*b* has a catch pole S2, a charging pole N1, a regulating pole S1, a developing pole N2, and a separating pole S3 provided on its circumferential surface. The charging pole N1 is disposed so as to be opposed to the guide channel 246. The charging pole N1 is designed to have its magnetic flux density peak in the guide channel 246, i.e., between the upstream end 2451 and the downstream end of the guide member 245*b*. The regulating pole S1 is disposed in a position opposed to the regulating member 243 (to be described later), so as to be adjacently downstream of the charging pole N1 in the rotational direction CW. The developing pole N2 is disposed in a position opposed to the developing area Da. The catch pole S2 and the separating pole S3 are the same as those described in the first embodiment, and therefore any descriptions thereof will be omitted.

Here, the peak magnetic flux densities of the catch pole S2, the charging pole N1, and the regulating pole S1, which are essential parts of the present embodiment, are as follows.

Catch pole S2: 45 mT

Charging pole N1: 50 mT

Regulating pole S1: 40 mT

The guide member 245*b* differs from the guide member 245*a* in that a protrusion 249, which is an example of a shear force applying unit is further included. There is no other difference between the guide members 245*a* and 245*b*. Therefore, elements of the guide member 245*b* that are the same as in the guide member 245*a* are denoted by the same reference characters, and any descriptions thereof will be omitted.

The protrusion 249 is provided so as to project from the surface of the guide member 245*b* that faces the developing roller 241, as shown in enlargement at the left in FIG. 21. Here, the normal line to the surface of the developing roller 241, which passes through the position where the magnetic flux density of the charging pole N1 peaks, will be denoted by NLb. The protrusion 249 is provided on the surface that faces the developing roller 241, so as to cross the normal line NLb.

Here, assuming that the distance (gap) from the outer circumferential surface of the developing roller 241 to the surface of the guide member 245*b* that is opposed thereto is g22, in the present embodiment, g22 is, for example, 1.5 mm. Also, assuming that the distance from the outer circumferential surface of the developing roller 241 to the protrusion 249 is g28, g28 is, for example, 0.6 mm.

In the above configuration, the outer circumferential surface of the developing roller 241 is supplied with the developer D through magnetic force applied by the catch pole S2. The developer D used here is as shown below.

Carrier: a ferrite core coated with a thin resin film, average particle size of 33 μm (magnetization of 60 emu/g)

Toner: average particle size of 6 μm

Toner to carrier ratio (T/C ratio): 7%

Figure 22A:
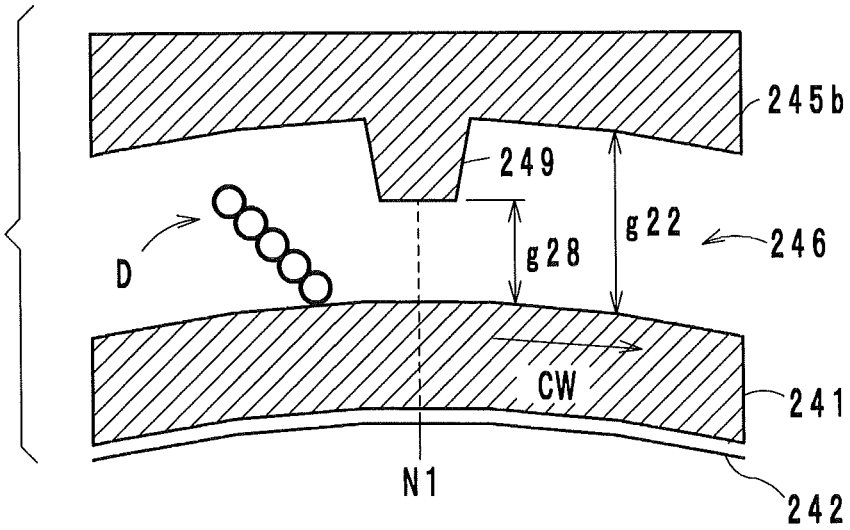
FIG. 22A is a schematic diagram illustrating the action and effect of the developing device of FIG. 21.
Figure 22B:
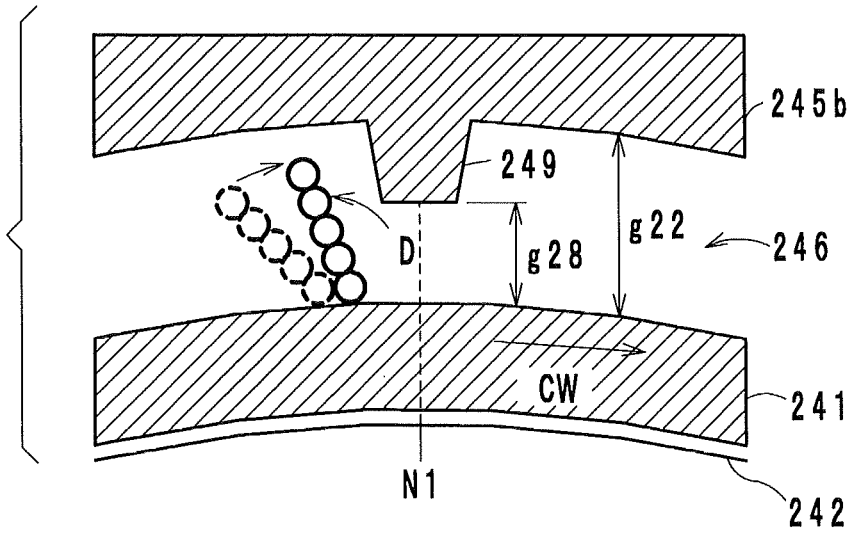
FIG. 22B is a schematic diagram illustrating the action and effect of the developing device of FIG. 21.

The developer D supported on the developing roller 241 reaches the upstream end 2451 of the guide member 245*b*, and the upstream end 2451 regulates the developer D into the guide channel 246. The developer D being fed through the guide channel 246 is spiking as it approaches the position where the magnetic flux density of the charging pole N1 peaks, as shown in FIGS. 22A and 22B.

Figure 22C:
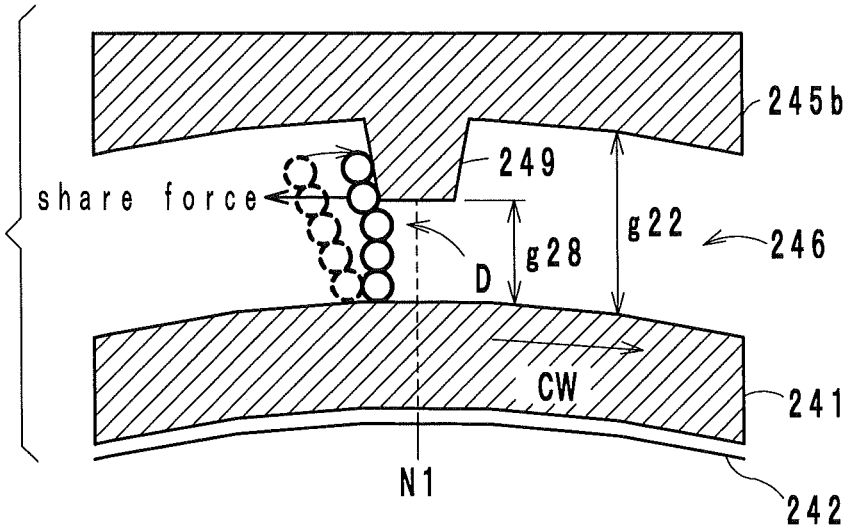
FIG. 22C is a schematic diagram illustrating the action and effect of the developing device of FIG. 21.

The developer D spiking at the peak position was observed, and its spikes were about 0.8 mm high. As mentioned earlier, since g28 is 0.6 mm, the top of the spiking developer D collides with the protrusion 249, as shown in FIG. 22C. As a result, shear force is applied to the spikes of the developer D against the rotational direction CW. Such shear force application allows better frictional charging between the magnetic carrier and the toner included in the developer D.

As described above, in the present embodiment, the upstream end 2451 of the guide member 245*b* regulates the developer D into the guide channel 246 first. The developer D guided into the guide channel 246 is highly likely to be provided ultimately to the developing area Da. The protrusion 249 applies shear force to that developer D, so that energy for frictional charging can be efficiently provided only to the developer D that is quite probably needed for developing.

Figure 23A:
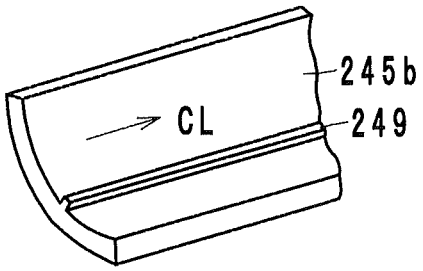
FIG. 23A is an oblique view illustrating an example of a protrusion in FIG. 21.
Figure 23B:
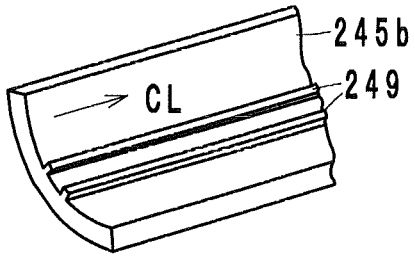
FIG. 23B is an oblique view illustrating another example of the protrusion in FIG. 21.
Figure 23C:
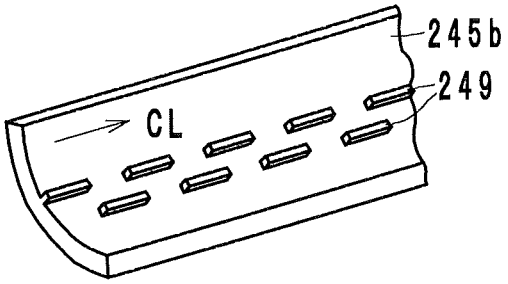
FIG. 23C is an oblique view illustrating still another example of the protrusion in FIG. 21.

Note that the protrusion 249 can take various forms as shown in FIGS. 23A through 23C. In FIG. 23A, the protrusion 249 is provided in the form of a line parallel to the center line of rotation CL (longitudinal direction) of the developing roller 241. In FIG. 23B, the protrusion 249 is provided in the form of two lines parallel to the longitudinal direction of the developing roller 241. In FIG. 23C, the protrusion 249 is provided on the surface of the guide member 245*b* in the form of two broken lines parallel to the longitudinal direction of the developing roller 241.

Third Embodiment

Figure 24:
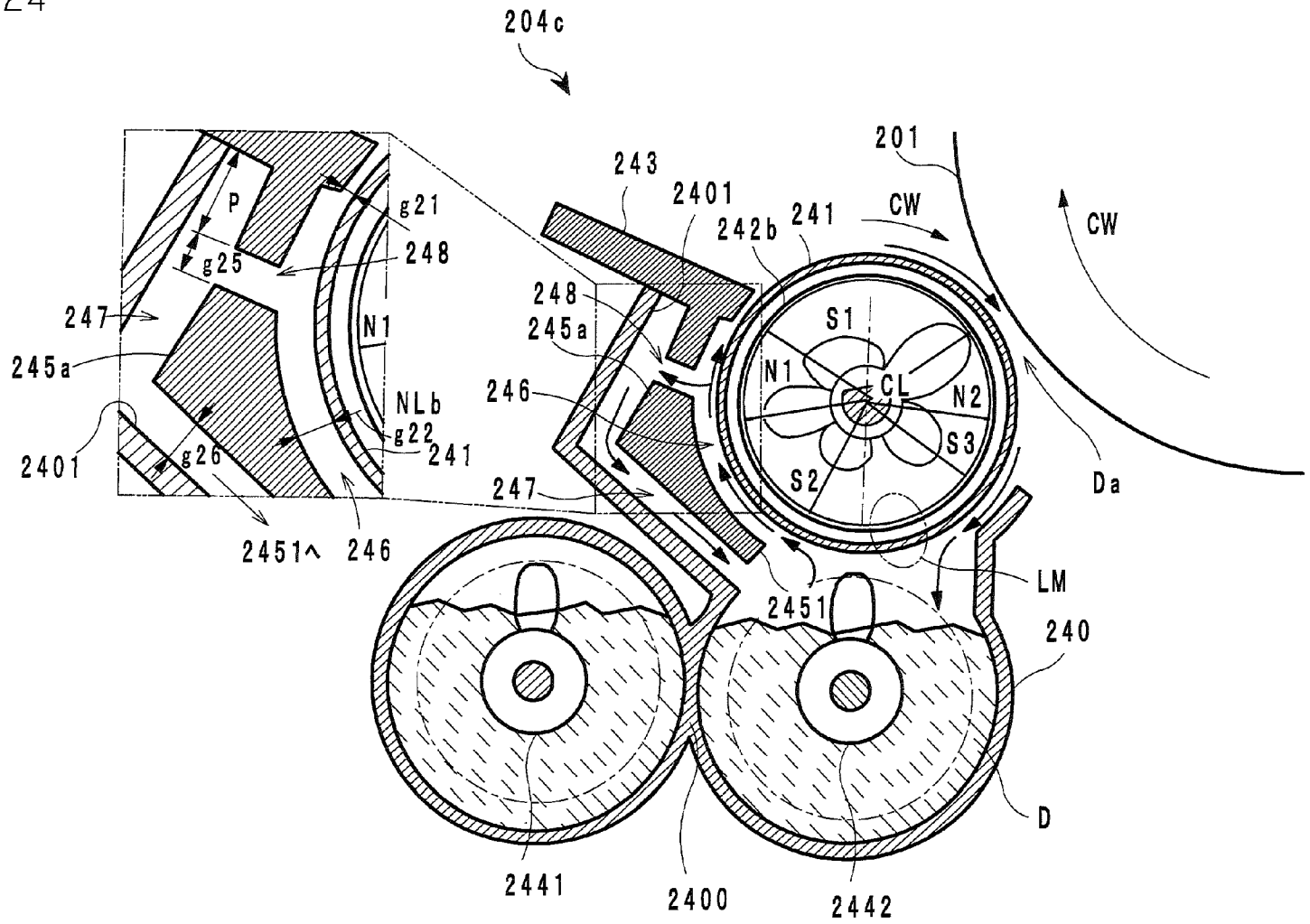
FIG. 24 is a vertical cross section schematically illustrating the configuration of a developing device according to a third embodiment.

FIG. 24 is a vertical cross section schematically illustrating the configuration of the developing device 204*c* of FIG. 17. In FIG. 24, the developing device 204*c* differs from the developing device 204*b* in that the same guide member 245*a* as in the first embodiment is provided in place of the guide member 245*b*, and the peak magnetic flux density of the charging pole N1 is higher than 50 mT. There is no other difference between the developing devices 204*b* and 204*c*. Therefore, in FIG. 24, elements corresponding to those in FIG. 18 are denoted by the same reference characters, and any descriptions thereof will be omitted.

Figure 25A:
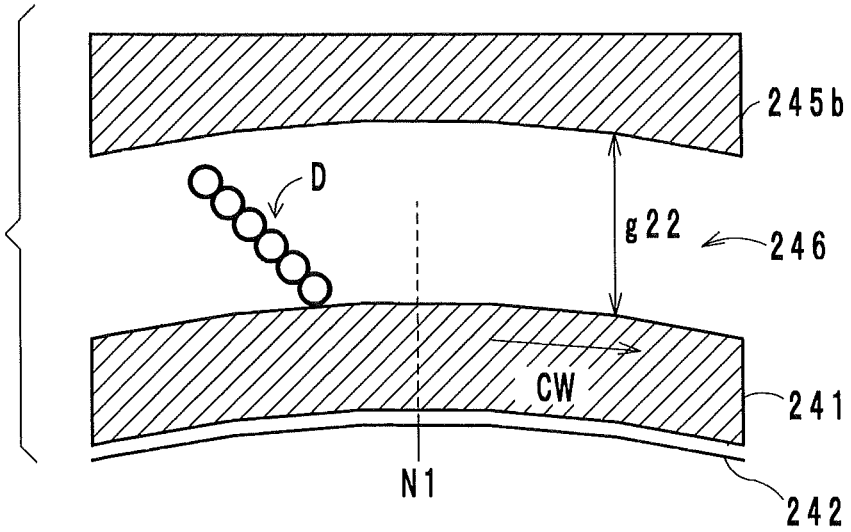
FIG. 25A is a schematic diagram illustrating the action and effect of the developing device of FIG. 24.
Figure 25B:
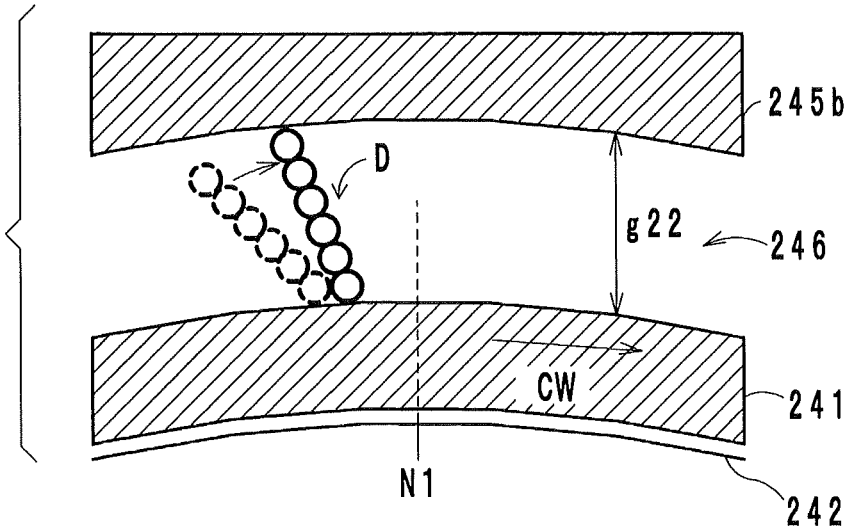
FIG. 25B is a schematic diagram illustrating the action and effect of the developing device of FIG. 24.

In the developing device 204*c* thus configured, the developer D supported on the developing roller 241 reaches the upstream end 2451 of the guide member 245*a*, and the upstream end 2451 regulates the developer D into the guide channel 246. The developer D being fed through the guide channel 246 is spiking as it approaches the position where the magnetic flux density of the charging pole N1 peaks, as shown in FIGS. 25A and 25B.

Figure 25C:
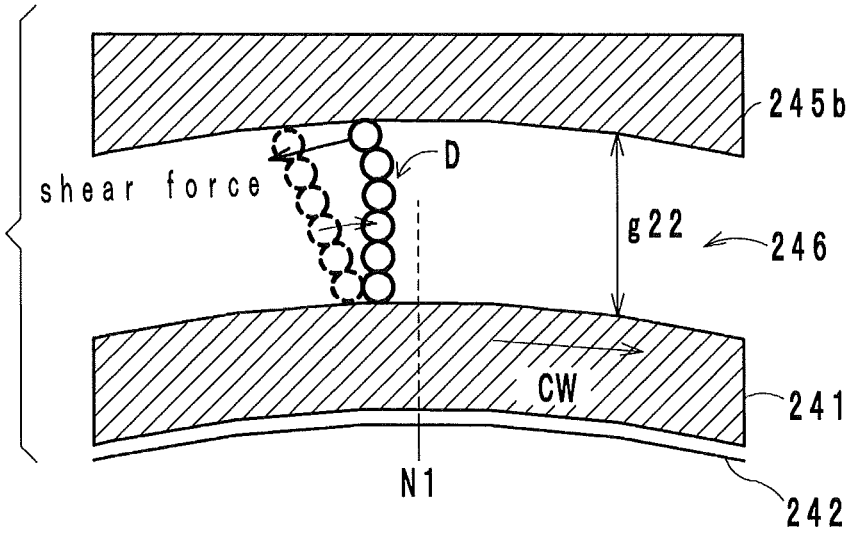
FIG. 25C is a schematic diagram illustrating the action and effect of the developing device of FIG. 24.

Here, since the peak magnetic flux density of the charging pole N1 is higher than 50 mT, when spikes of the developer D approximately reach the peak position, the spikes collide with the surface of the guide member 245*a* that faces the developing roller 241, from diagonally below, as shown in FIG. 25C. As a result, shear force is applied to the spikes of the developer D approximately in the opposite direction to the rotational direction CW. In this manner, in the present embodiment, the surface that faces the guide member 245*a* acts as a shear force applying unit. Such shear force application allows frictional charging between the magnetic carrier and the toner included in the developer D. Thus, technical advantages similar to those of the second embodiment can be offered.

Note that in the above embodiments, the image forming apparatus 210 has been described as forming a monochrome image. However, this is not restrictive, and any of the developing devices 204*a* to 204*c* may be employed in an image forming apparatus for color image formation. Moreover, in such a case, for example, the image forming apparatus includes developing devices for four colors yellow, magenta, cyan, and black, and at least one of the developing devices is the developing device described in the present embodiment.

Furthermore, since the image forming apparatus 210 includes any of the developing devices 204*a* to 204*c*, stress on the developer can be minimized, and further, deterioration of the developer can be reduced. Thus, occurrence of an image defect or suchlike can be inhibited, making it possible to provide an image forming apparatus 210 capable of forming a satisfactory image.

Although the present invention has been described in connection with the preferred embodiment above, it is to be noted that various changes and modifications are possible to those who are skilled in the art. Such changes and modifications are to be understood as being within the scope of the invention.

What is claimed is:

1. A developing device for forming a toner image by developing an electrostatic latent image formed on an electrostatic image support using a developer, the device comprising:

a housing that stores the developer and has a supply space from which the developer is supplied;

a developer support that is opposed to the electrostatic image support and rotates while supporting the developer supplied from the supply space, thereby feeding the developer to a developing area opposed to the electrostatic image support; and a magnet assembly that is fixed inside the developer support and has a plurality of magnetic poles, at least including a catch pole, a developing pole, and a separating pole, wherein, the catch pole is opposed to the supply space so as to attract the developer from the supply space onto the developer support, the developing pole is opposed to the developing area, the separating pole is disposed downstream of the developing pole and upstream of the catch pole in a rotational direction of the developer support, and creates a low magnetic area for separating the developer not used in the developing area from the developer support, the developing device further includes:

a guide member that is disposed downstream of the supply space in the rotational direction of the developer support, with a gap from the developer support, thereby creating a guide channel for guiding the developer being fed thereto while being supported on the developer support; and a regulating member that is disposed downstream of the guide member and upstream of the developing area in the rotational direction, so as to be opposed to developer support member with a gap therefrom, thereby regulating the amount of the developer that has passed through the guide channel, the guide member further creates a reflux channel in a gap from an inner surface of the housing, the reflux channel is connected to the guide channel via a communication channel such that the developer regulated by the regulating member returns toward an upstream end of the guide member against the rotational direction, the upstream end of the guide member is disposed in a position opposed to the position where the magnetic flux density of the catch pole peaks or in a position upstream of the catch pole and downstream of the low magnetic area, and the magnet assembly further includes a feeding pole that is disposed downstream of the catch pole and upstream of the developing pole in the rotational direction, so as to be opposed to the guide channel.

2. The developing device according to claim 1, wherein the guide member has a shape determined on the basis of a spiked shape of the developer passing through the guide channel.

3. The developing device according to claim 1, wherein the gap between the guide member and the developer support is sized on the basis of a position where the developer passing through the guide channel spikes most.

4. The developing device according to claim 1, wherein the guide member is shaped so as to accord with a spiked shape of the developer at a portion that faces the feeding pole, and is disposed so as to create a space for preventing the spiking developer from being rubbed against the guide member.

5. An image forming apparatus comprising a developing device of claim 1.

6. A developing device for forming a toner image by developing an electrostatic latent image formed on an electrostatic image support using a developer, the device comprising:

a housing that stores the developer;

a developer support that is opposed to the electrostatic image support and rotates while supporting the developer supplied from the housing, thereby feeding the developer to a developing area opposed to the electrostatic image support;

a guide member that is disposed downstream of a supply space in the housing from which the developer is supplied, in the rotational direction of the developer support, so as to be opposed to the developer support with a gap therefrom, such that the developer supported on the developer support passes through the gap;

a regulating member that is disposed downstream of the guide member in the rotational direction, so as to be opposed to the developer support at a distance therefrom and with a gap from the developer support, thereby regulating the amount of the developer that has passed through the gap between the guide member and the developer support; and a magnet assembly that is fixed inside the developer support and has a plurality of magnetic poles, at least including a catch pole, a feeding pole, and a regulating pole arranged from upstream to downstream in the rotational direction, wherein, the catch pole is approximately opposed to the supply space so as to attract the developer from the supply space onto the developer support, the feeding pole is disposed in a position opposed to the guide member, so as to be adjacently upstream of the regulating pole in the rotational direction, a peak of the regulating pole is approximately opposed to the regulating member, the guide member has an upstream end disposed downstream of a position where the magnetic flux density of the catch pole peaks, in the rotational direction, and upstream of or at a position where the feeding pole has a magnetic flux density of substantially zero, in the rotational direction, and a magnetic attractive force applied at the upstream end is lower than a magnetic attractive force in the gap between the developer support and the regulating member.

7. The developing device according to claim 6, wherein, the gap between the guide member and the developer support is used as a guide channel in which the developer supported on the developer support passes, the guide member further creates a reflux channel in a gap from an inner surface of the housing, and the reflux channel is connected to the guide channel via a communication channel such that the developer regulated by the regulating member returns toward an upstream end of the guide member against the rotational direction.

8. An image forming apparatus comprising a developing device of claim 6.

9. A developing device for forming a toner image by developing an electrostatic latent image formed on an electrostatic image support using a developer, the device comprising:

a housing that stores the developer;

a developer support that is opposed to the electrostatic image support and rotates while supporting the developer supplied from the housing, thereby feeding the developer to a developing area opposed to the electrostatic image support; and a magnet assembly that is fixed inside the developer support and has a plurality of magnetic poles, at least including a catch pole, a charging pole, a regulating pole, and a developing pole, wherein, the catch pole is opposed to a supply space in the housing from which the developer is supplied, so as to attract the developer from the supply space onto the developer support, the charging pole is disposed downstream of the catch pole in a rotational direction of the developer support, the regulating pole is disposed downstream of the charging pole in the rotational direction, the developing pole is disposed downstream of the regulating pole in the rotational direction so as to be opposed to the developing area, the developing device further includes:

a guide member that is disposed downstream of the supply space in the rotational direction, so as to be opposed to the charging pole with a gap from the developer support, thereby creating a guide channel through which the developer supported on the developer support is fed; and a regulating member that is disposed downstream of the guide member in the rotational direction, so as to be opposed to the regulating pole with a gap from the developer support, thereby regulating the amount of the developer that has passed through the guide channel, the guide member further creates a reflux channel in a gap from an inner surface of the housing, the reflux channel is connected to the guide channel via a communication channel such that the developer regulated by the regulating member returns toward an upstream end of the guide member against the rotational direction, and the developing device further includes a shear force applying unit for applying a shear force to a top of the developer in the guide channel that is caused to spike by a magnetic force from the charging pole.

10. The developing device according to claim 9, wherein the developer spiking in the guide channel has a spike height greater than a distance of the gap between the developer support and the guide member.

11. The developing device according to claim 9, wherein the shear force applying unit is a protrusion provided on a surface of the guide member that faces the developing roller, in a position where a magnetic flux density of the charging pole peaks.

12. An image forming apparatus comprising a developing device of claim 9.

13. The developing device according to claim 6, wherein the peak of the regulating pole is opposed to the regulating member.

* * * * *